US010443389B2

(12) United States Patent
Dietrich et al.

(10) Patent No.: US 10,443,389 B2
(45) Date of Patent: Oct. 15, 2019

(54) TURBINE BLADE HAVING IMPROVED FLUTTER CAPABILITY AND INCREASED TURBINE STAGE OUTPUT

(71) Applicants: Douglas James Dietrich, West Palm Beach, FL (US); Jeff Tessier, Hobe Sound, FL (US); Megan Burke, West Palm Beach, FL (US); Stephen Wayne Fiebiger, Jupiter, FL (US); Roy E. Struble, West Palm Beach, FL (US); Christopher Charles Williams, Littleton, CO (US); Alexander Vasili Rozendaal, Palm Beach Gardens, FL (US); Lonnie Adolphus Houck, III, Palm City, FL (US)

(72) Inventors: Douglas James Dietrich, West Palm Beach, FL (US); Jeff Tessier, Hobe Sound, FL (US); Megan Burke, West Palm Beach, FL (US); Stephen Wayne Fiebiger, Jupiter, FL (US); Roy E. Struble, West Palm Beach, FL (US); Christopher Charles Williams, Littleton, CO (US); Alexander Vasili Rozendaal, Palm Beach Gardens, FL (US); Lonnie Adolphus Houck, III, Palm City, FL (US)

( * ) Notice: Subject to any disclaimer, the term of this patent is extended or adjusted under 35 U.S.C. 154(b) by 174 days.

(21) Appl. No.: 15/808,415

(22) Filed: Nov. 9, 2017

(65) Prior Publication Data

US 2019/0136696 A1 May 9, 2019

(51) Int. Cl.

| | |
|---|---|
| ***F01D 5/14*** | (2006.01) |
| ***F01D 5/12*** | (2006.01) |
| ***F01D 11/00*** | (2006.01) |

(52) U.S. Cl.

CPC ..... *F01D 5/12* (2013.01); *F01D 11/006* (2013.01); *F05D 2250/74* (2013.01); *F05D 2300/611* (2013.01)

(58) Field of Classification Search

CPC ... F01D 5/12; F01D 5/14; F01D 5/141; F01D 11/006; F05D 2250/74; F05D 2300/611

(Continued)

(56) References Cited

U.S. PATENT DOCUMENTS 6,474,948 B1 * 11/2002 Pirolla ..... F01D 5/141 416/223 A 6,769,878 B1 8/2004 Parker et al.

(Continued)

FOREIGN PATENT DOCUMENTS

EP 1411210 A1 4/2004

OTHER PUBLICATIONS

International Search Report and Written Opinion dated Nov. 21, 2013 (12 pages).

*Primary Examiner* — Justin D Seabe
*Assistant Examiner* — Joshua R Beebe
(74) *Attorney, Agent, or Firm* — Hovey Williams LLP

(57) ABSTRACT

A turbine blade, airfoil, and rotor stage for a gas turbine engine is disclosed. The turbine blade, airfoil, and rotor stage each includes an uncoated airfoil profile in accordance with Cartesian coordinate values of X, Y, and Z disclosed herein. The resulting airfoil exhibits high flutter margins, thus enabling the gas turbine engine to be operated at an increased power output while avoiding operational limitations required in known gas turbine engines.

17 Claims, 16 Drawing Sheets

(58) Field of Classification Search
USPC ..... 416/500, DIG. 2
See application file for complete search history.

(56) References Cited

U.S. PATENT DOCUMENTS

| | | | | |
|---|---|---|---|---|
| 8,821,125 | B2 * | 9/2014 | Hart | F01D 5/141 416/193 A |
| 9,011,101 | B2 * | 4/2015 | Gustafson | F01D 5/141 416/223 A |
| 2005/0019160 | A1 | 1/2005 | Hyde et al. | |
| 2005/0025618 | A1 * | 2/2005 | Arness | F01D 5/141 415/191 |
| 2005/0111978 | A1 | 5/2005 | Strohl et al. | |
| 2009/0097980 | A1 | 4/2009 | Hayasaka et al. | |
| 2009/0290987 | A1 * | 11/2009 | Parker | F01D 5/141 416/241 R |
| 2010/0061862 | A1 * | 3/2010 | Bonini | F01D 5/141 416/223 R |
| 2010/0172752 | A1 * | 7/2010 | McGovern | F01D 9/041 415/208.1 |
| 2012/0051928 | A1 * | 3/2012 | LaMaster | F01D 5/141 416/223 A |
| 2012/0219410 | A1 * | 8/2012 | Kathika | F01D 5/141 415/208.1 |

* cited by examiner

TURBINE BLADE HAVING IMPROVED FLUTTER CAPABILITY AND INCREASED TURBINE STAGE OUTPUT

CROSS-REFERENCE TO RELATED APPLICATIONS

Not applicable.

TECHNICAL FIELD

The present invention generally relates to gas turbine engines. More specifically, a turbine blade is disclosed having an airfoil profile that reduces aerodynamic flutter while increasing the overall power output from the stage of the turbine.

BACKGROUND OF THE INVENTION

A typical gas turbine engine comprises a compressor, at least one combustor, and a turbine, with the compressor and turbine coupled together through an axial shaft. In operation, air passes through the compressor, where the pressure of the air increases and then passes to a combustion section, where fuel is mixed with the compressed air in one or more combustion chambers and ultimately ignited. The hot combustion gases then pass into the turbine and drive the turbine. As the turbine rotates, the compressor turns, since they are coupled together along a common shaft. The turning of the shaft also drives a generator for electrical applications. The engine must operate within the confines of the environmental regulations for the area in which the engine is located. As a result, more advanced combustion systems have been developed to more efficiently mix fuel and air so as to provide more complete combustion, which results in lower emissions.

As the demand for more powerful and efficient turbine engines continues to increase, it is necessary to improve the efficiency at each stage of the turbine, so as to get the most work possible out of the turbine. To achieve this efficiency improvement, it is necessary to remove any design defects that limit the turbine from achieving its maximum performance. Turbine blades have been known to be limited in power output by a variety of conditions including, but not limited to creep, flutter, and erosion.

Flutter is a dangerous condition caused by the interaction of an airfoil's structural modes of vibration with the aerodynamic pressure distribution on the blade. As the airfoil portion of the turbine blade vibrates, its pressure magnitudes and distributions fluctuate due to the changing flow path geometry. This can result in energy being either added to the flow (a condition know as positive aero-damping) or energy being extracted from the flow (negative aero-damping). If the energy being extracted from the flow is greater than can be dissipated through mechanical damping, the amplitude of the displacements will increase. The cycle repeats itself and is compounded until either the energy input and energy dissipated balance each other, or failure occurs. In order to avoid excessive flutter, which can cause component failure, limitations may be placed upon the operating condition of the turbine. Furthermore, excessive flutter outside of acceptable limits can cause the turbine blade to fail over time.

SUMMARY

Embodiments of the present invention are directed towards a system and method for, among other things, a turbine blade having an increased power output which avoids operational limitations found in prior art turbine blade designs.

In one embodiment of the present invention, a turbine blade is disclosed having an attachment, a neck, a platform extending radially outward from the neck, an airfoil extending radially outward from the platform, and a shroud extending radially outward from the airfoil, where the airfoil has an uncoated profile substantially in accordance with Cartesian coordinate values of X, Y, and Z as set forth in Table 1, carried to three decimal places, wherein Z is a distance measured radially from the platform.

In an alternative embodiment of the present invention, an airfoil for a turbine blade is discussed having an uncoated profile substantially in accordance with the Cartesian coordinate values of X, Y, and Z as set forth in Table 1, carried to three decimal places.

In yet another embodiment of the present invention, a turbine rotor stage is disclosed having a plurality of turbine blades secured to a rotor disk, the turbine blades each having an airfoil including an uncoated profile substantially in accordance with the Cartesian coordinate values of X, Y, and Z as set forth in Table 1, carried to three decimal places.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 2:
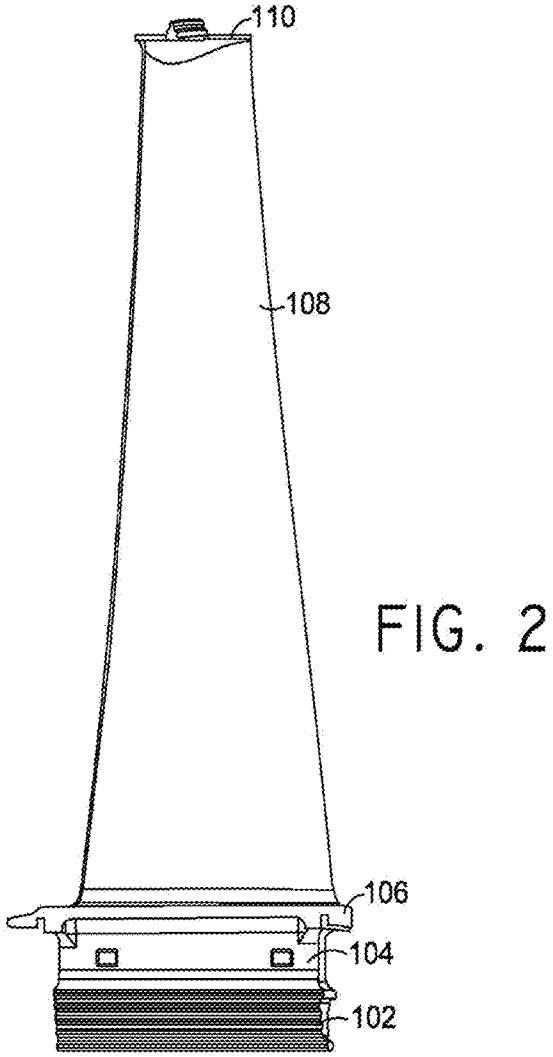
FIG. 2 depicts an elevation view of the turbine blade shown in FIG. 1.
Figure 1:
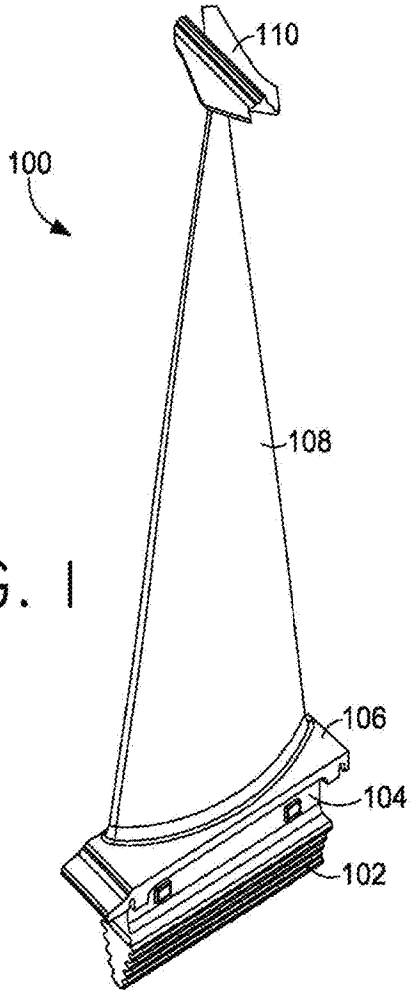
FIG. 1 depicts a perspective view of a turbine blade according to one embodiment of the invention.
Figure 3:
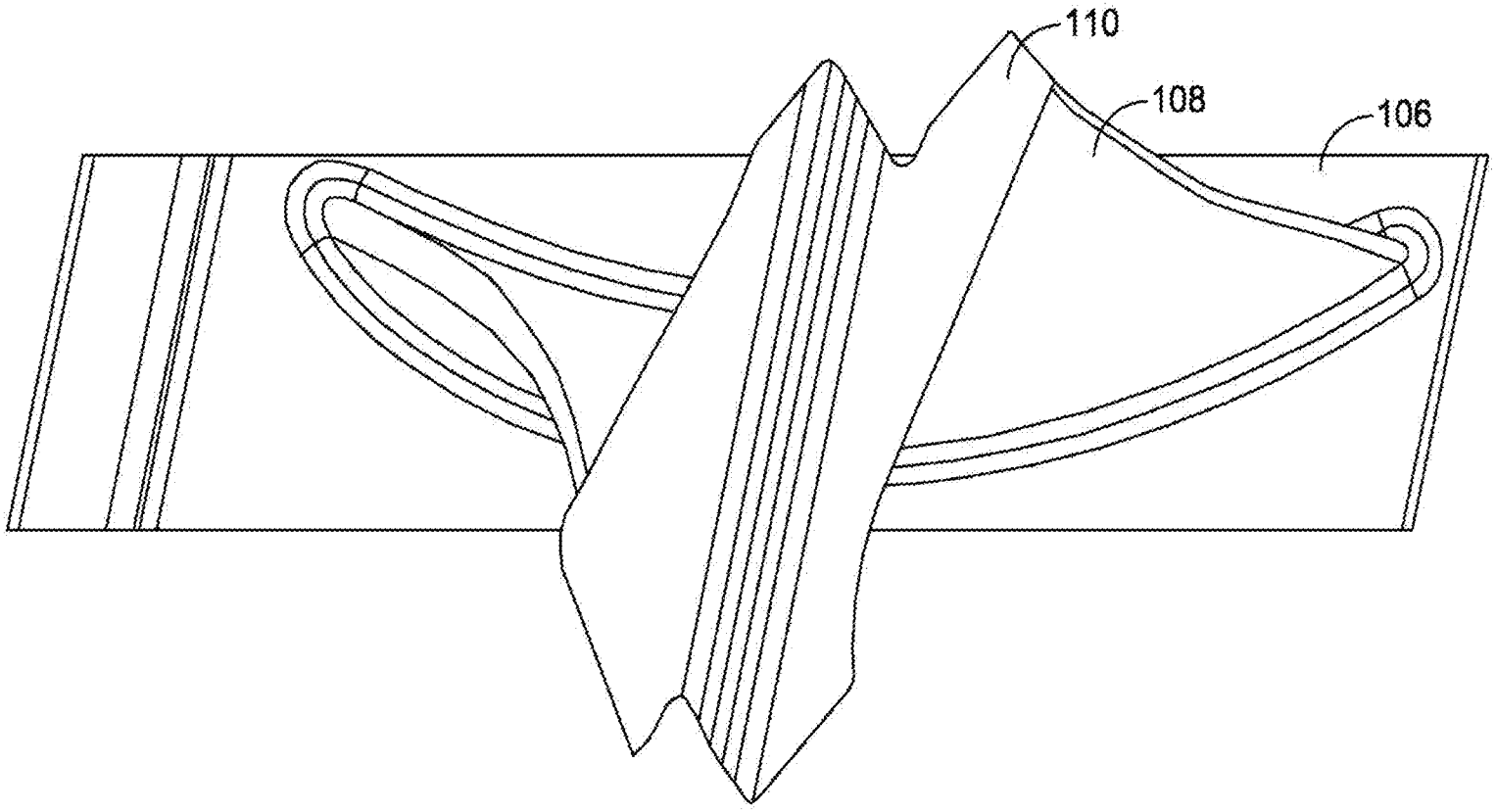
FIG. 3 depicts a top view of the turbine blade shown in FIG. 1.
Figure 4A:
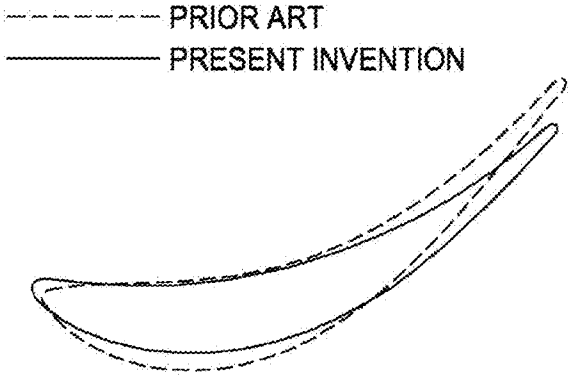
FIGS. 4A-4E depict a series of cross-section views taken at various spans along an airfoil of the turbine blade shown in FIG. 1, and compares the series of cross-section views to a series of cross-section views taken at corresponding spans along a prior-art airfoil.
Figure 4B:
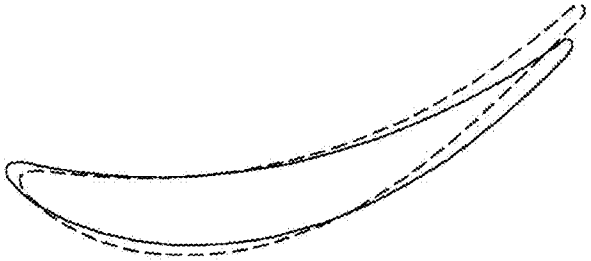
Figure 4C:
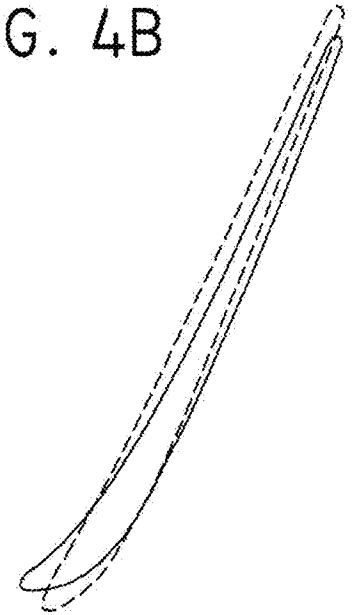
Figure 4D:
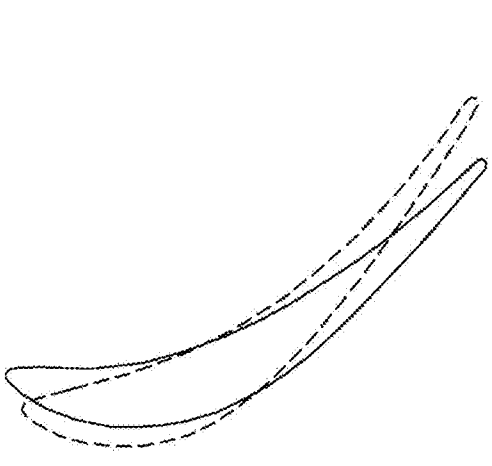
Figure 4E:
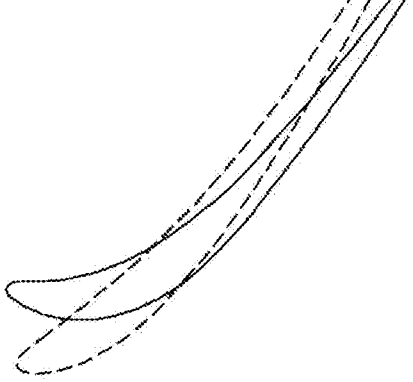

Referring initially to FIGS. 1-3, a turbine blade 100 in accordance with an embodiment of the present invention is disclosed. The turbine blade 100 comprises an attachment 102, a neck 104 extending radially outward from the attachment 102, and a platform 106 extending radially outward from the neck 104. An airfoil 108 extends radially outward from the platform 106 and a shroud 110 extends radially outward from the airfoil 108. The airfoil 108 has an uncoated profile substantially in accordance with Cartesian coordinate values of X, Y, and Z as set forth in Table 1, carried to three decimal places, where Z is a distance measured radially from the platform 106. All coordinate values X, Y, and Z are measured in inches. FIGS. 4A-4E depict a series of airfoil cross sections taken at various span positions for a prior-art blade and the blade depicted in FIGS. 1-3.

Figure 6:
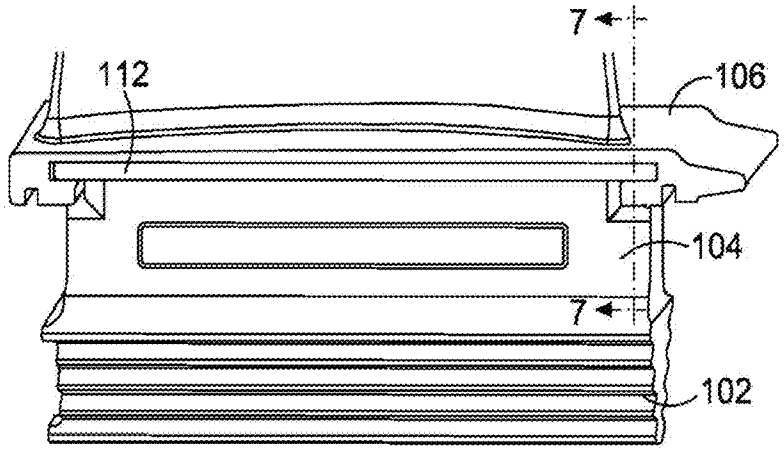
FIG. 6 depicts a portion of a blade root and blade seal passage in an elevation view in accordance with an embodiment of the invention.

The turbine blade 100 also comprises a recessed region 112 (FIGS. 6-7) that extends along a portion of the axial length of the platform 106 between the platform 106 and the attachment 102. Located within the recessed region 112 is a seal pin 114 that serves to seal any gap between adjacent turbine blades 100.

The turbine blade 100 is fabricated through a casting and machining process. Specifically, in an embodiment of the present invention, the turbine blade is cast from a nickel-based superalloy. Examples of acceptable alloys include, but are not limited to, Rene 80, GTD111, and MGA2400. For the embodiment disclosed herein, the airfoil 108 of the turbine blade 100 has a modified profile as compared to prior-art airfoils—more particularly, the airfoil 108 includes a modified spanwise stiffness distribution—which improves its natural frequency margin over the vibratory drivers. In addition, the modified airfoil 108 profile reduces bending stress by balancing the hot gas induced bending loads with centrifugal loading.

As a result of the casting process, the profile of the airfoil 108 can vary typically up to 0.030 inches relative to the nominal coordinates shown in Table 1. In order to provide further thermal capability, the airfoil 108 of the turbine blade 100 comprises a MCrAlY bond coating of approximately 0.0055 inches thick, where M can be a variety of metals including, but not limited to Cobalt, Nickel, or a Cobalt Nickel mixture. By application of the bond coating, the turbine blade 100 achieves an improved oxidation resistance over the prior-art configuration.

As previously discussed, FIGS. 4A-4E depict a plurality of section views taken through turbine blade 100 and overlaid on top of section views taken from the prior-art turbine blade at the same radial percent span. For example, representative sections are taken at 10% span, 30% span, 50% span, 70% span and the tip of the airfoil adjacent to the shroud. As can be seen from each of the cross-section views, the lower span chord and thickness distributions have been modified to change the resonant frequencies of the bladed rotor. Specifically, the natural frequencies of certain vibratory modes were decreased while others were increased. These modifications provide safe margins to avoid vibratory drivers in the engine. Moreover, the new airfoil shape includes chord and thickness distributions to provide improved flutter capability at a higher design mass flow rate than that of the prior-art airfoil designs, while maintaining vibratory driver margin.

Figure 5:
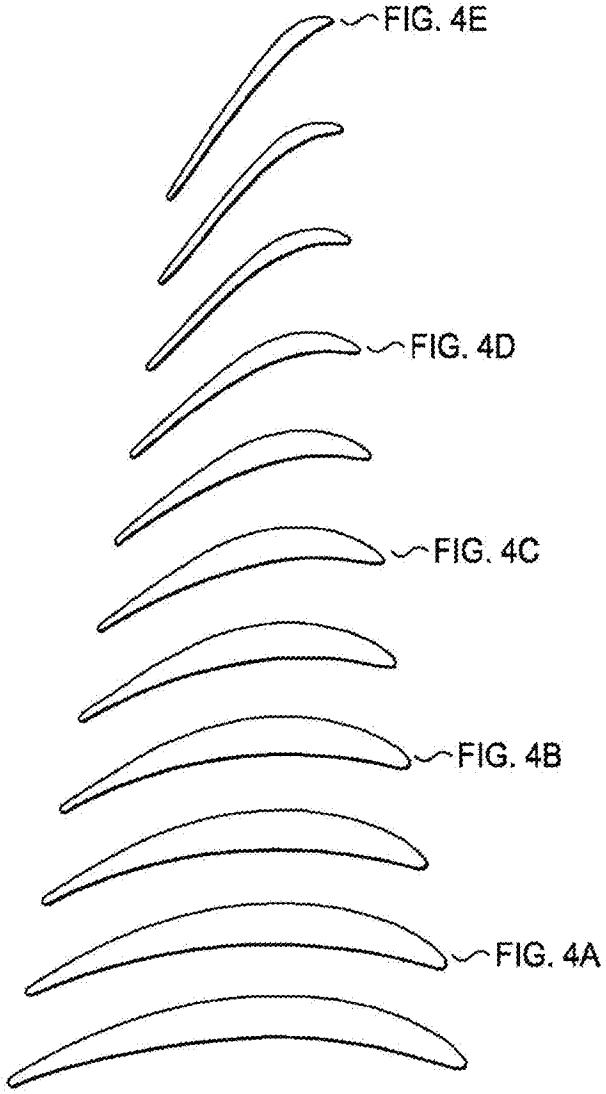
FIG. 5 depicts a perspective view of a series of airfoil sections outlined in the Cartesian coordinates of Table 1.

The airfoil 108 of the present invention is generated by connecting X, Y coordinates with a smooth arc at a number of Z positions extending radially outward from the blade platform 106. In one embodiment, twenty-one sections of X, Y coordinate data are first connected together using a smooth arc. These sections, some of which are shown in FIG. 5, are then connected together by a series of smooth curves to generate the airfoil 108 surface.

Figure 8A:
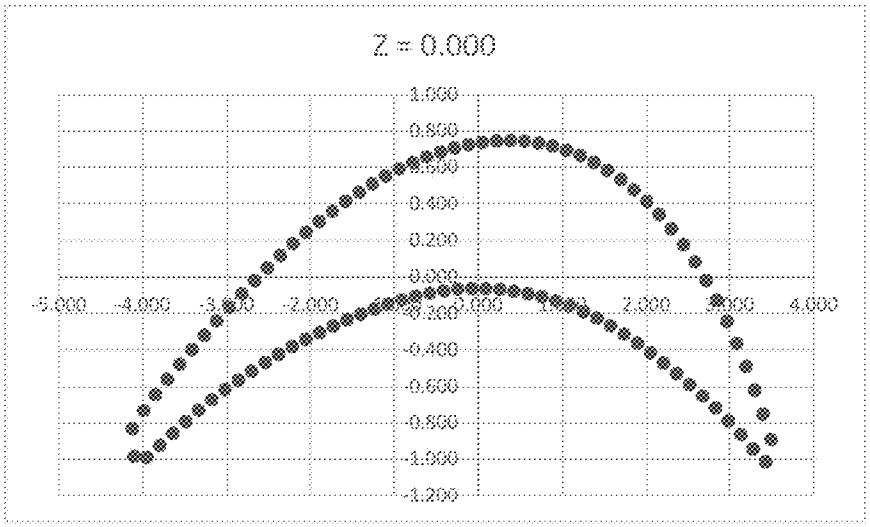
FIGS. 8A-8U depict scatter plots of X, Y coordinate data of Table 1, each at a corresponding Z position.
Figure 8B:
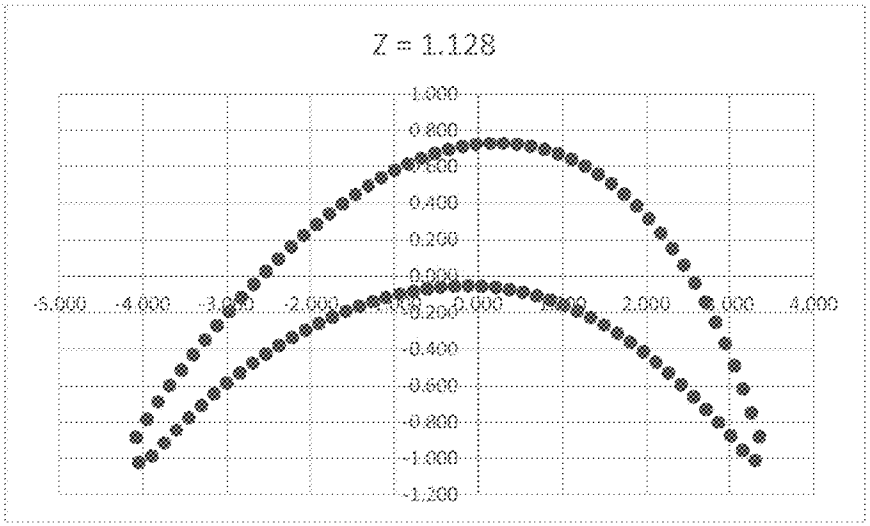
Figure 8C:
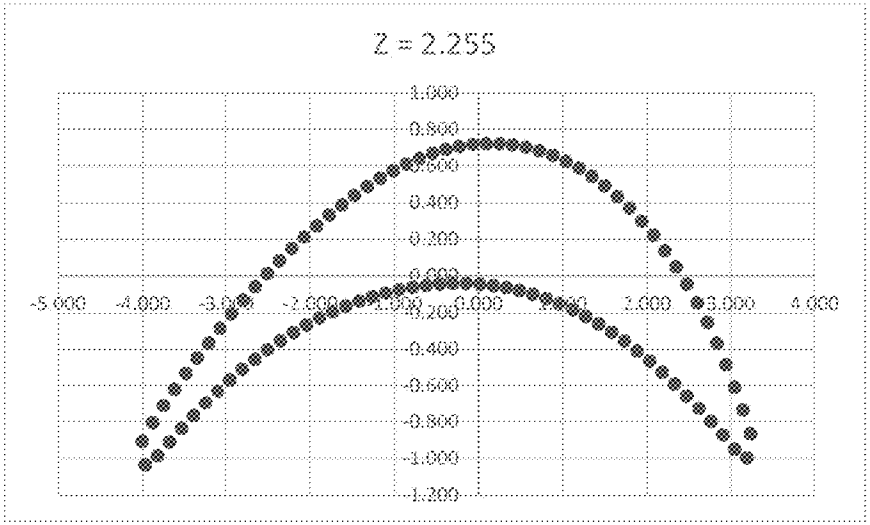
Figure 8D:
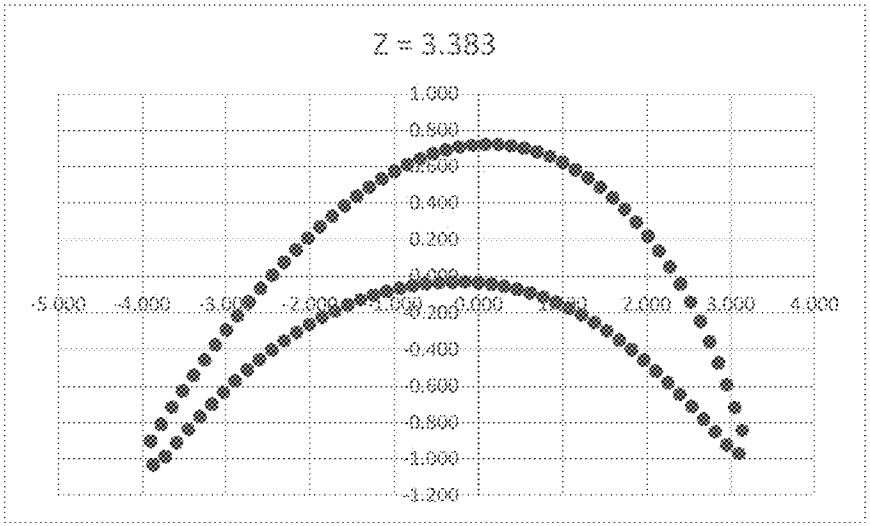
Figure 8E:
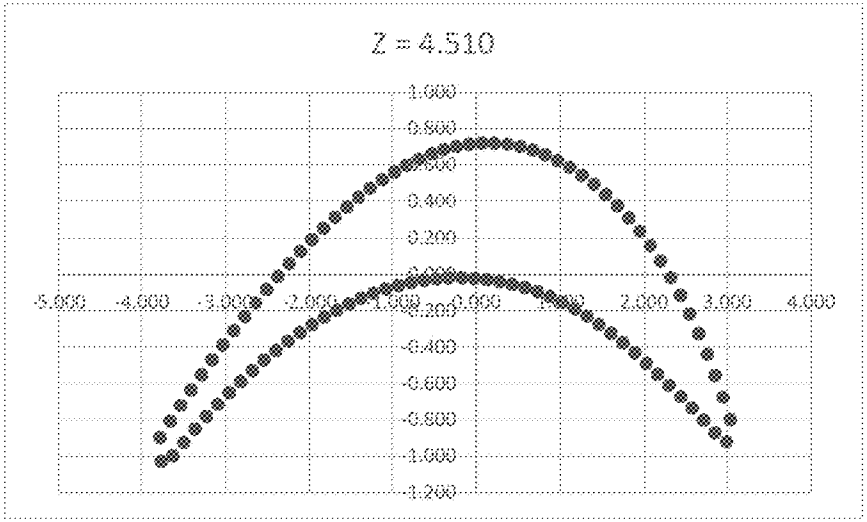
Figure 8F:
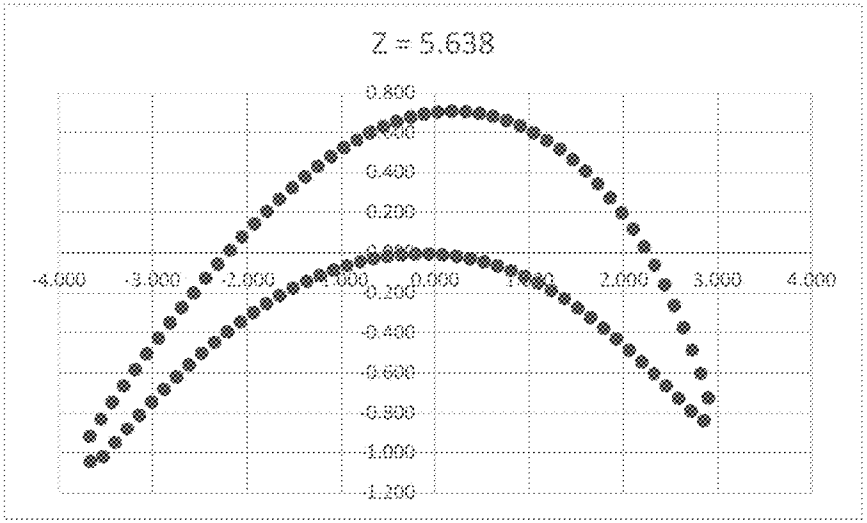
Figure 8G:
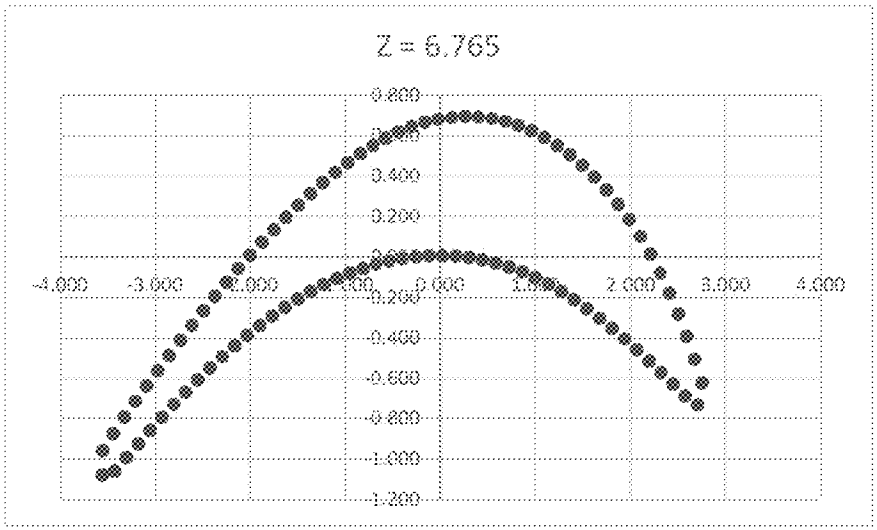
Figure 8H:
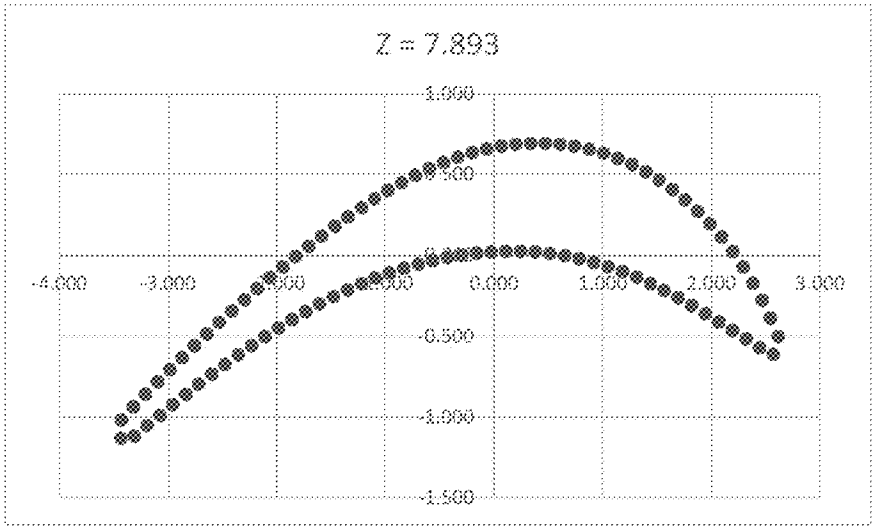
Figure 8I:
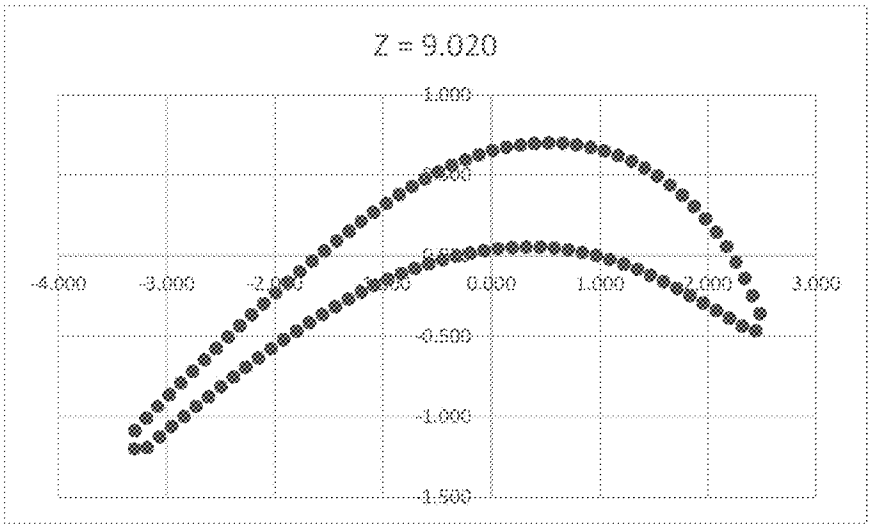
Figure 8J:
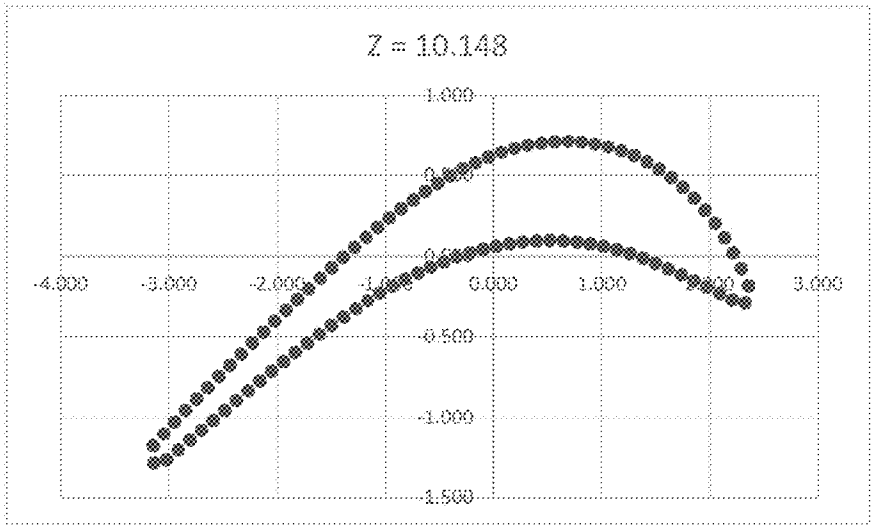
Figure 8K:
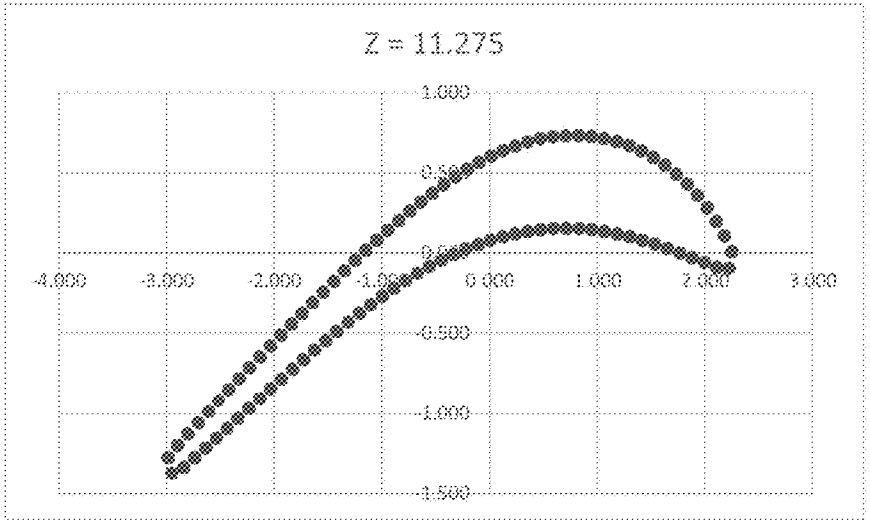
Figure 8L:
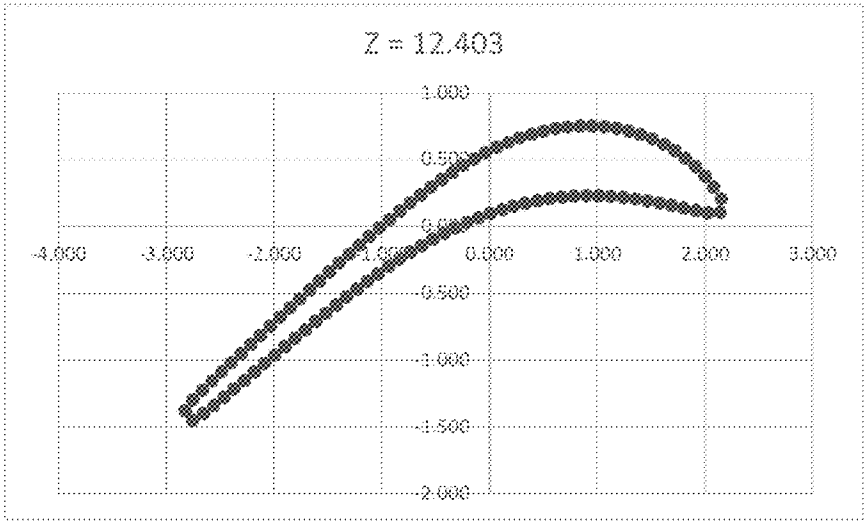
Figure 8M:
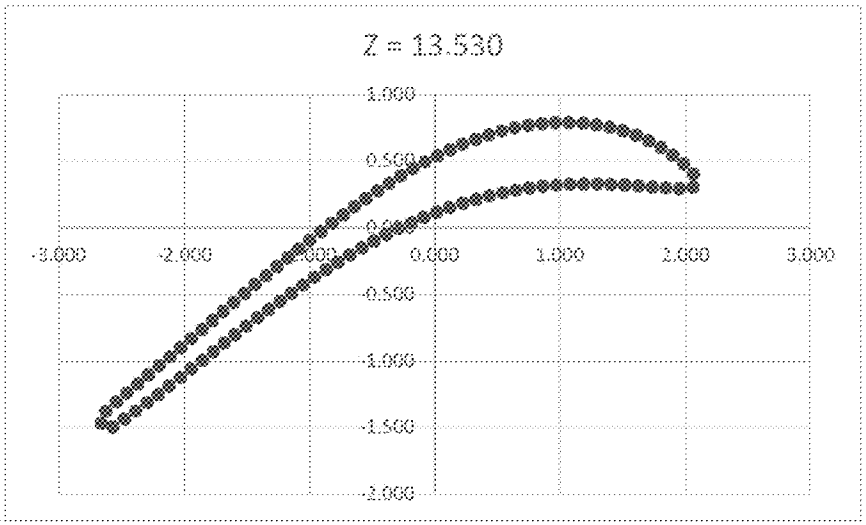
Figure 8N:
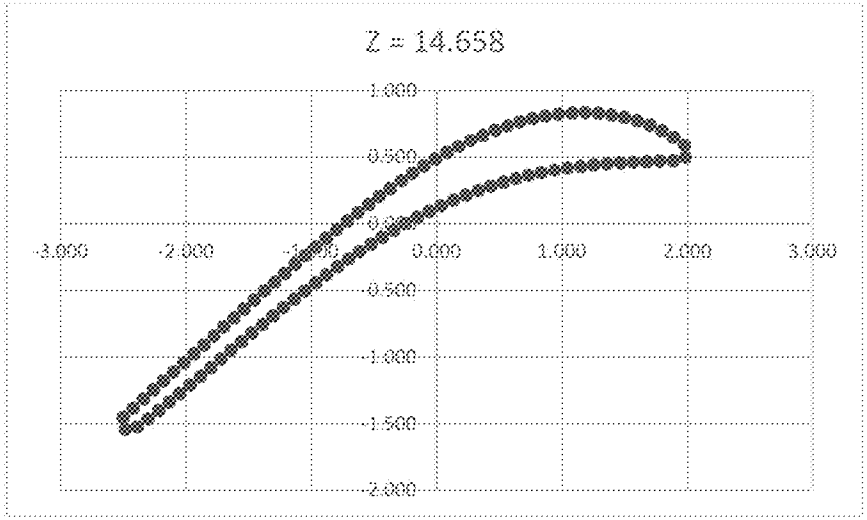
Figure 8O:
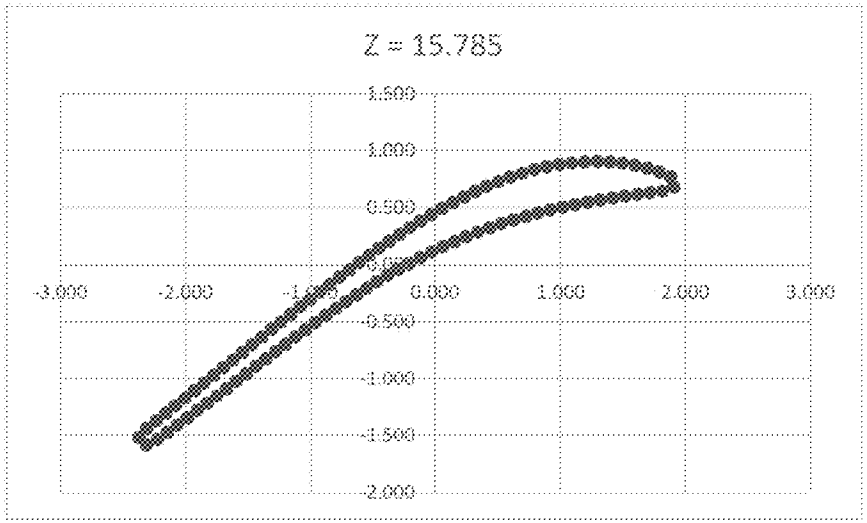
Figure 8P:
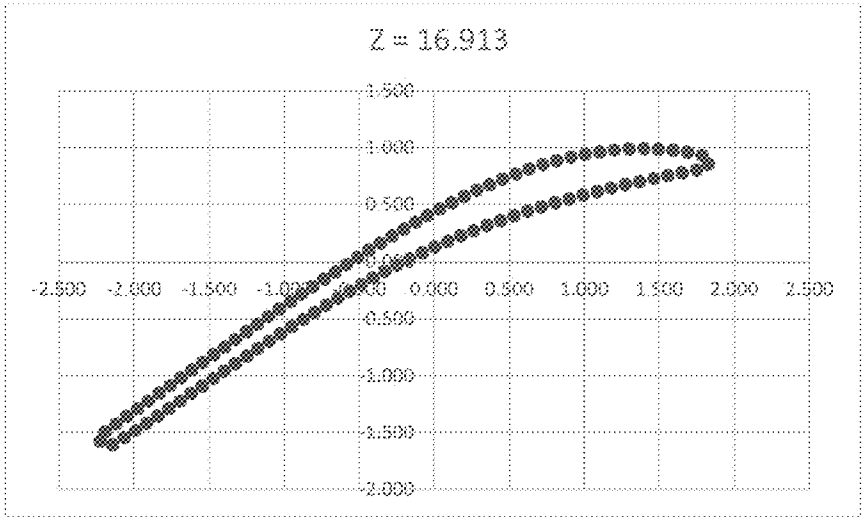
Figure 8Q:
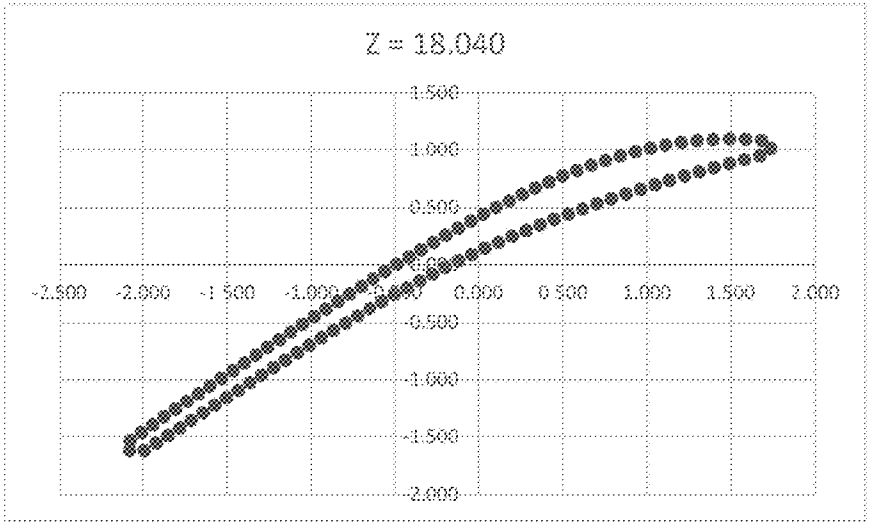
Figure 8R:
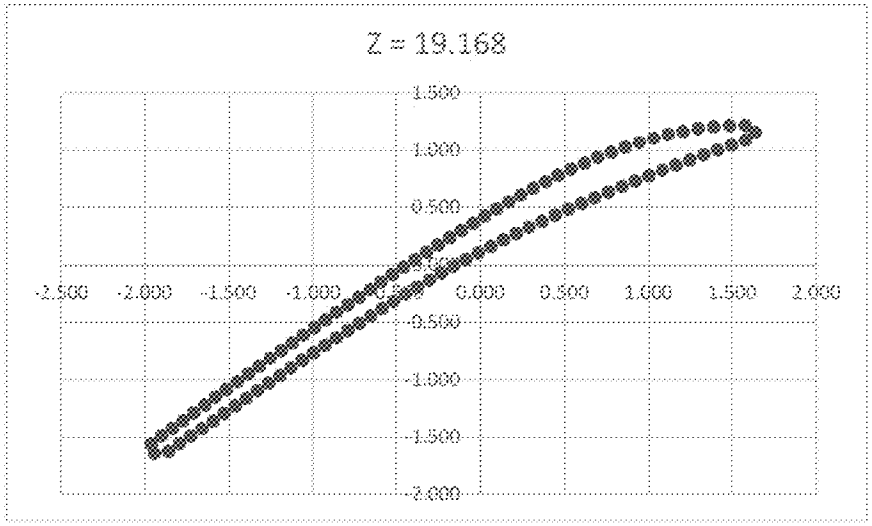
Figure 8S:
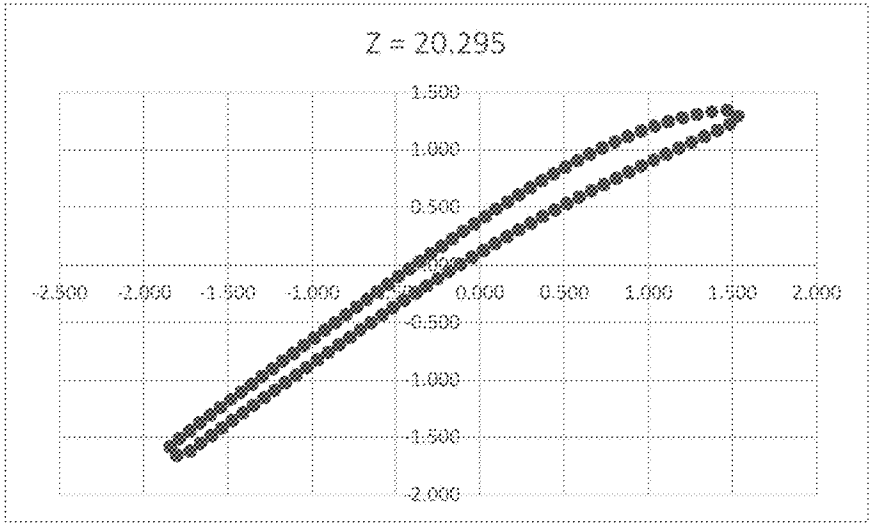
Figure 8T:
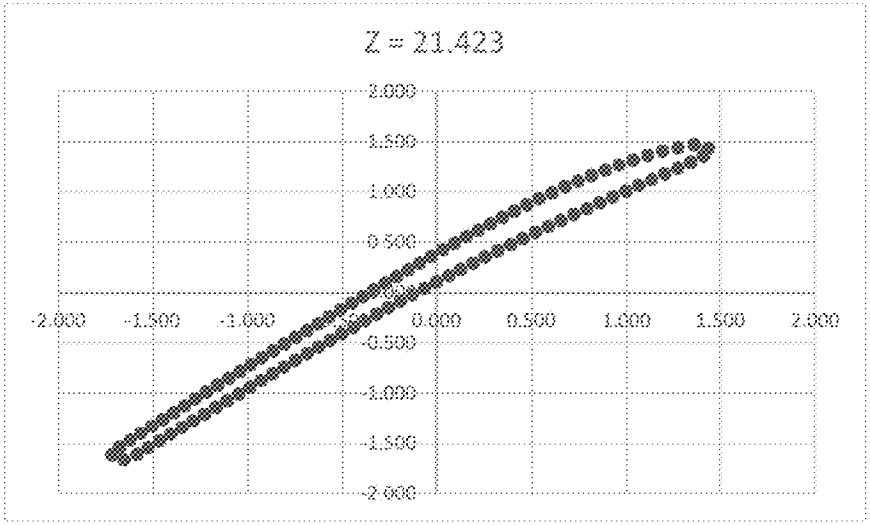
Figure 8U:
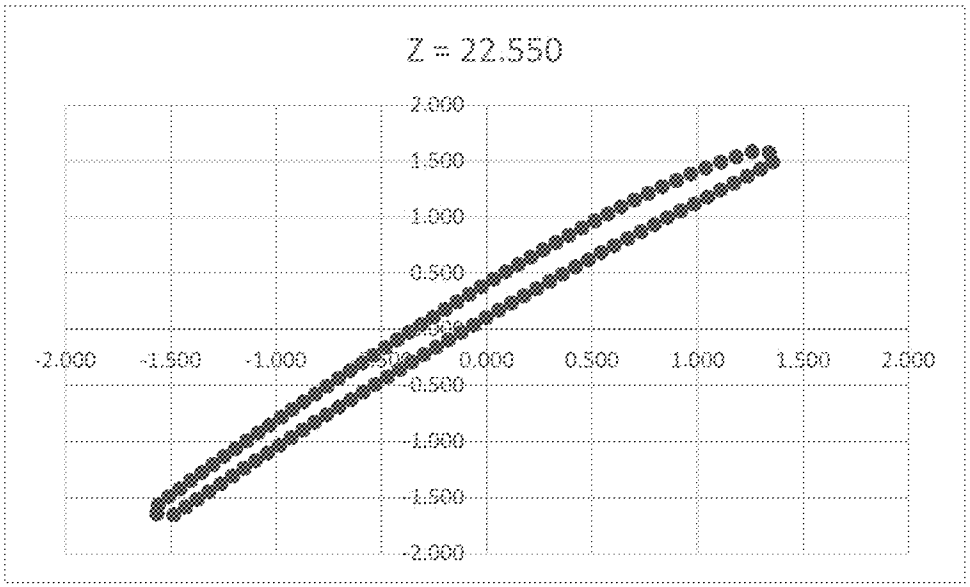

For example, FIGS. 8A-8U depict scatter plots of the X, Y coordinate data at multiple Z positions extending radially outward from the blade platform. First, FIG. 8A is a scatter plot of the X, Y coordinate data along the uncoated profile of the airfoil 108 at Z=0.000; i.e., along the radially outermost surface of platform 106. As can be seen in FIG. 8A, the X, Y, and Z Cartesian coordinates set forth in Table 1 are measured relative to an origin located on the radially outermost surface of platform 106 substantially at an apex of the airfoil 108's concave side (i.e., pressure side). FIGS. 8B-8U, in turn, show scatter plots of the X, Y coordinate data along the uncoated profile of the airfoil 108 at various Z values; more particularly, at Z=1.128, 2.255, 3.383, 4.510, 5.638, 6.765, 7.893, 9.020, 10.148, 11.275, 12.403, 13.530, 14.658, 15.785, 16.913, 18.040, 19.168, 20.295, 21.423, and 22.550, respectively. The airfoil 108 of the present invention is generated by connecting the X, Y coordinates shown in each of the scatter plots with a smooth arc to form twenty-one profile sections, and by connecting those twenty-one profile sections together by a series of smooth curves to generate the airfoil surface.

An alternative embodiment of the present invention is directed to the airfoil 108 for the turbine blade 100, which, as discussed, has an uncoated profile substantially in accordance with Cartesian coordinate values of X, Y, and Z as set forth in Table 1 carried to three decimal places. Again, the airfoil 108 is formed by connecting adjacent sections of X, Y coordinate data at a series of Z positions measured radially from a platform. Because the airfoil 108 is cast, there are tolerances in the casting process, and as such the airfoil 108 can vary in profile and position by about +/−0.030 inches.

In yet another embodiment of the present invention, a plurality of turbine blades 100 are secured to a rotor disk to form a rotor stage. The plurality of turbine blades 100 each have an airfoil 108 having an uncoated profile substantially in accordance with Cartesian coordinate values of X, Y, and Z as set forth in Table 1.

The airfoil 108 profile described herein yields a noticeable improvement in predicted flutter margin over prior-art configurations. Thus, the airfoil 108 maintains aerodynamic stability over the complete range of inter-blade phase angles for critical vibratory modes at the design-point operating condition, whereas prior-art configurations exhibited a narrow range of conditional aerodynamic instability mitigated by mechanical damping contributions. This improved flutter resistance provides the ability to attain higher operating mass flow with increased work extraction.

Figure 7:
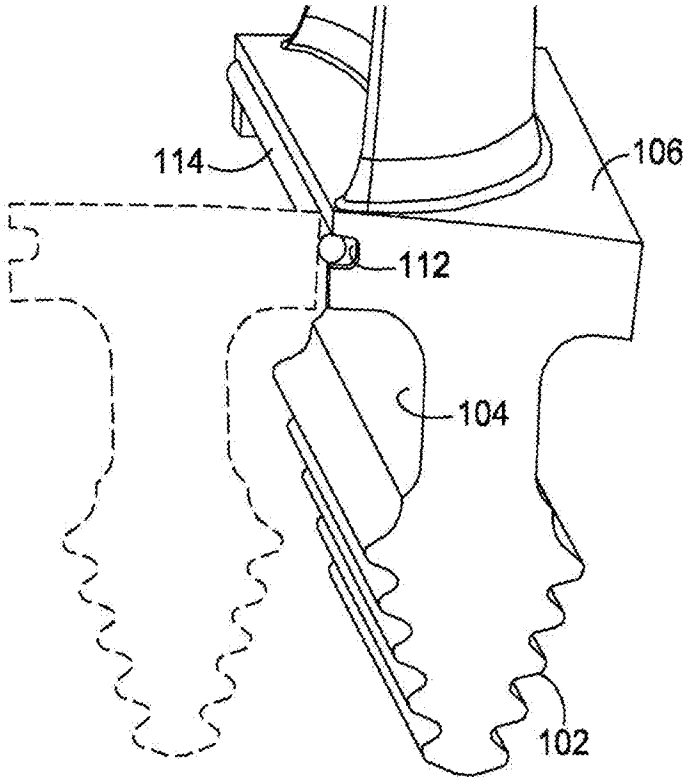
FIG. 7 depicts a portion of a rotor assembly and blade seals taken in a cross-section through FIG. 6.

As previously discussed, the turbine blade 100 also utilizes a seal 114 for sealing the axially-extending gap between adjacent platforms 106 in a rotor stage. The seal and its positioning can be seen from FIGS. 6 and 7. Specifically, the seal 114 is positioned in a recessed region 112 of the platform 106, where the recessed region 112 extends axially along a majority of a length of the platform 106. As shown in FIG. 7, when a second turbine blade is positioned adjacent to the seal 114, and the blades are in operation, under centrifugal loading, the gap between mating turbine blades is then blocked by the seal 114.

TABLE 1

| X | Y | Z |
|---|---|---|
| 3.493 | −0.893 | 0.000 |
| 3.430 | −1.015 | 0.000 |

TABLE 1-continued

| X | Y | Z |
|---|---|---|
| 3.280 | −0.945 | 0.000 |
| 3.133 | −0.866 | 0.000 |
| 2.984 | −0.792 | 0.000 |
| 2.832 | −0.721 | 0.000 |
| 2.679 | −0.654 | 0.000 |
| 2.525 | −0.590 | 0.000 |
| 2.370 | −0.530 | 0.000 |
| 2.213 | −0.471 | 0.000 |
| 2.055 | −0.416 | 0.000 |
| 1.897 | −0.363 | 0.000 |
| 1.738 | −0.313 | 0.000 |
| 1.577 | −0.267 | 0.000 |
| 1.415 | −0.226 | 0.000 |
| 1.252 | −0.190 | 0.000 |
| 1.088 | −0.159 | 0.000 |
| 0.923 | −0.132 | 0.000 |
| 0.758 | −0.110 | 0.000 |
| 0.592 | −0.092 | 0.000 |
| 0.425 | −0.078 | 0.000 |
| 0.258 | −0.069 | 0.000 |
| 0.091 | −0.065 | 0.000 |
| −0.076 | −0.065 | 0.000 |
| −0.242 | −0.069 | 0.000 |
| −0.409 | −0.077 | 0.000 |
| −0.576 | −0.090 | 0.000 |
| −0.742 | −0.107 | 0.000 |
| −0.908 | −0.127 | 0.000 |
| −1.073 | −0.150 | 0.000 |
| −1.238 | −0.176 | 0.000 |
| −1.403 | −0.205 | 0.000 |
| −1.567 | −0.236 | 0.000 |
| −1.730 | −0.269 | 0.000 |
| −1.894 | −0.304 | 0.000 |
| −2.056 | −0.342 | 0.000 |
| −2.218 | −0.382 | 0.000 |
| −2.380 | −0.424 | 0.000 |
| −2.541 | −0.469 | 0.000 |
| −2.701 | −0.516 | 0.000 |
| −2.861 | −0.566 | 0.000 |
| −3.019 | −0.618 | 0.000 |
| −3.177 | −0.674 | 0.000 |
| −3.333 | −0.733 | 0.000 |
| −3.488 | −0.795 | 0.000 |
| −3.642 | −0.859 | 0.000 |
| −3.795 | −0.925 | 0.000 |
| −3.949 | −0.991 | 0.000 |
| −4.104 | −0.986 | 0.000 |
| −4.122 | −0.834 | 0.000 |
| −3.989 | −0.735 | 0.000 |
| −3.848 | −0.645 | 0.000 |
| −3.704 | −0.560 | 0.000 |
| −3.559 | −0.478 | 0.000 |
| −3.412 | −0.398 | 0.000 |
| −3.265 | −0.320 | 0.000 |
| −3.117 | −0.242 | 0.000 |
| −2.968 | −0.167 | 0.000 |
| −2.818 | −0.093 | 0.000 |
| −2.667 | −0.021 | 0.000 |
| −2.515 | 0.049 | 0.000 |
| −2.363 | 0.116 | 0.000 |
| −2.209 | 0.181 | 0.000 |
| −2.054 | 0.244 | 0.000 |
| −1.898 | 0.303 | 0.000 |
| −1.741 | 0.359 | 0.000 |
| −1.582 | 0.412 | 0.000 |
| −1.423 | 0.462 | 0.000 |
| −1.262 | 0.508 | 0.000 |
| −1.101 | 0.551 | 0.000 |
| −0.938 | 0.589 | 0.000 |
| −0.775 | 0.624 | 0.000 |
| −0.611 | 0.655 | 0.000 |
| −0.446 | 0.682 | 0.000 |
| −0.281 | 0.704 | 0.000 |
| −0.114 | 0.722 | 0.000 |
| 0.052 | 0.735 | 0.000 |
| 0.219 | 0.743 | 0.000 |
| 0.386 | 0.745 | 0.000 |
| 0.553 | 0.741 | 0.000 |

TABLE 1-continued

| X | Y | Z |
|---|---|---|
| 0.720 | 0.731 | 0.000 |
| 0.886 | 0.715 | 0.000 |
| 1.051 | 0.692 | 0.000 |
| 1.215 | 0.662 | 0.000 |
| 1.378 | 0.626 | 0.000 |
| 1.540 | 0.583 | 0.000 |
| 1.699 | 0.533 | 0.000 |
| 1.856 | 0.476 | 0.000 |
| 2.010 | 0.412 | 0.000 |
| 2.162 | 0.341 | 0.000 |
| 2.309 | 0.262 | 0.000 |
| 2.452 | 0.176 | 0.000 |
| 2.590 | 0.082 | 0.000 |
| 2.722 | −0.020 | 0.000 |
| 2.849 | −0.129 | 0.000 |
| 2.970 | −0.243 | 0.000 |
| 3.086 | −0.364 | 0.000 |
| 3.196 | −0.490 | 0.000 |
| 3.300 | −0.620 | 0.000 |
| 3.399 | −0.755 | 0.000 |
| 3.353 | −0.881 | 1.128 |
| 3.304 | −1.012 | 1.128 |
| 3.155 | −0.956 | 1.128 |
| 3.012 | −0.877 | 1.128 |
| 2.867 | −0.801 | 1.128 |
| 2.721 | −0.729 | 1.128 |
| 2.572 | −0.659 | 1.128 |
| 2.423 | −0.593 | 1.128 |
| 2.272 | −0.530 | 1.128 |
| 2.120 | −0.470 | 1.128 |
| 1.967 | −0.414 | 1.128 |
| 1.812 | −0.361 | 1.128 |
| 1.656 | −0.312 | 1.128 |
| 1.499 | −0.267 | 1.128 |
| 1.340 | −0.226 | 1.128 |
| 1.181 | −0.190 | 1.128 |
| 1.020 | −0.158 | 1.128 |
| 0.859 | −0.130 | 1.128 |
| 0.697 | −0.107 | 1.128 |
| 0.535 | −0.088 | 1.128 |
| 0.372 | −0.073 | 1.128 |
| 0.209 | −0.062 | 1.128 |
| 0.046 | −0.056 | 1.128 |
| −0.118 | −0.053 | 1.128 |
| −0.281 | −0.055 | 1.128 |
| −0.445 | −0.061 | 1.128 |
| −0.608 | −0.070 | 1.128 |
| −0.771 | −0.082 | 1.128 |
| −0.934 | −0.098 | 1.128 |
| −1.096 | −0.117 | 1.128 |
| −1.258 | −0.139 | 1.128 |
| −1.420 | −0.164 | 1.128 |
| −1.581 | −0.192 | 1.128 |
| −1.741 | −0.224 | 1.128 |
| −1.901 | −0.258 | 1.128 |
| −2.060 | −0.295 | 1.128 |
| −2.219 | −0.336 | 1.128 |
| −2.376 | −0.379 | 1.128 |
| −2.533 | −0.426 | 1.128 |
| −2.689 | −0.476 | 1.128 |
| −2.844 | −0.529 | 1.128 |
| −2.997 | −0.585 | 1.128 |
| −3.150 | −0.644 | 1.128 |
| −3.300 | −0.707 | 1.128 |
| −3.449 | −0.774 | 1.128 |
| −3.597 | −0.844 | 1.128 |
| −3.744 | −0.915 | 1.128 |
| −3.892 | −0.987 | 1.128 |
| −4.044 | −1.022 | 1.128 |
| −4.077 | −0.884 | 1.128 |
| −3.949 | −0.782 | 1.128 |
| −3.816 | −0.687 | 1.128 |
| −3.679 | −0.598 | 1.128 |
| −3.540 | −0.513 | 1.128 |
| −3.398 | −0.430 | 1.128 |
| −3.257 | −0.349 | 1.128 |
| −3.114 | −0.270 | 1.128 |
| −2.970 | −0.192 | 1.128 |

TABLE 1-continued

| X | Y | Z |
|---|---|---|
| −2.824 | −0.117 | 1.128 |
| −2.678 | −0.045 | 1.128 |
| −2.530 | 0.026 | 1.128 |
| −2.382 | 0.094 | 1.128 |
| −2.232 | 0.160 | 1.128 |
| −2.081 | 0.223 | 1.128 |
| −1.929 | 0.283 | 1.128 |
| −1.776 | 0.341 | 1.128 |
| −1.622 | 0.395 | 1.128 |
| −1.467 | 0.446 | 1.128 |
| −1.310 | 0.494 | 1.128 |
| −1.153 | 0.538 | 1.128 |
| −0.994 | 0.578 | 1.128 |
| −0.835 | 0.614 | 1.128 |
| −0.674 | 0.645 | 1.128 |
| −0.513 | 0.671 | 1.128 |
| −0.351 | 0.693 | 1.128 |
| −0.188 | 0.709 | 1.128 |
| −0.025 | 0.721 | 1.128 |
| 0.138 | 0.727 | 1.128 |
| 0.302 | 0.728 | 1.128 |
| 0.465 | 0.722 | 1.128 |
| 0.628 | 0.711 | 1.128 |
| 0.791 | 0.694 | 1.128 |
| 0.953 | 0.670 | 1.128 |
| 1.113 | 0.639 | 1.128 |
| 1.273 | 0.602 | 1.128 |
| 1.430 | 0.558 | 1.128 |
| 1.585 | 0.507 | 1.128 |
| 1.738 | 0.449 | 1.128 |
| 1.889 | 0.385 | 1.128 |
| 2.036 | 0.314 | 1.128 |
| 2.180 | 0.236 | 1.128 |
| 2.320 | 0.151 | 1.128 |
| 2.455 | 0.060 | 1.128 |
| 2.586 | −0.038 | 1.128 |
| 2.712 | −0.142 | 1.128 |
| 2.833 | −0.252 | 1.128 |
| 2.948 | −0.368 | 1.128 |
| 3.058 | −0.490 | 1.128 |
| 3.162 | −0.616 | 1.128 |
| 3.260 | −0.746 | 1.128 |
| 3.237 | −0.865 | 2.255 |
| 3.194 | −0.997 | 2.255 |
| 3.048 | −0.950 | 2.255 |
| 2.908 | −0.872 | 2.255 |
| 2.767 | −0.798 | 2.255 |
| 2.624 | −0.726 | 2.255 |
| 2.480 | −0.657 | 2.255 |
| 2.334 | −0.590 | 2.255 |
| 2.188 | −0.527 | 2.255 |
| 2.040 | −0.466 | 2.255 |
| 1.891 | −0.409 | 2.255 |
| 1.740 | −0.356 | 2.255 |
| 1.588 | −0.307 | 2.255 |
| 1.434 | −0.263 | 2.255 |
| 1.280 | −0.222 | 2.255 |
| 1.124 | −0.185 | 2.255 |
| 0.967 | −0.153 | 2.255 |
| 0.810 | −0.125 | 2.255 |
| 0.652 | −0.101 | 2.255 |
| 0.494 | −0.081 | 2.255 |
| 0.334 | −0.065 | 2.255 |
| 0.175 | −0.053 | 2.255 |
| 0.015 | −0.046 | 2.255 |
| −0.144 | −0.042 | 2.255 |
| −0.304 | −0.042 | 2.255 |
| −0.464 | −0.046 | 2.255 |
| −0.624 | −0.053 | 2.255 |
| −0.783 | −0.063 | 2.255 |
| −0.943 | −0.077 | 2.255 |
| −1.102 | −0.094 | 2.255 |
| −1.260 | −0.114 | 2.255 |
| −1.418 | −0.138 | 2.255 |
| −1.576 | −0.165 | 2.255 |
| −1.732 | −0.196 | 2.255 |
| −1.888 | −0.231 | 2.255 |
| −2.044 | −0.269 | 2.255 |

TABLE 1-continued

| X | Y | Z |
|---|---|---|
| −2.198 | −0.310 | 2.255 |
| −2.352 | −0.355 | 2.255 |
| −2.504 | −0.403 | 2.255 |
| −2.655 | −0.455 | 2.255 |
| −2.805 | −0.510 | 2.255 |
| −2.954 | −0.568 | 2.255 |
| −3.102 | −0.630 | 2.255 |
| −3.248 | −0.695 | 2.255 |
| −3.391 | −0.765 | 2.255 |
| −3.534 | −0.837 | 2.255 |
| −3.676 | −0.910 | 2.255 |
| −3.818 | −0.984 | 2.255 |
| −3.965 | −1.036 | 2.255 |
| −4.001 | −0.907 | 2.255 |
| −3.877 | −0.806 | 2.255 |
| −3.749 | −0.710 | 2.255 |
| −3.618 | −0.620 | 2.255 |
| −3.483 | −0.533 | 2.255 |
| −3.347 | −0.449 | 2.255 |
| −3.210 | −0.367 | 2.255 |
| −3.072 | −0.286 | 2.255 |
| −2.933 | −0.208 | 2.255 |
| −2.792 | −0.132 | 2.255 |
| −2.650 | −0.059 | 2.255 |
| −2.507 | 0.013 | 2.255 |
| −2.363 | 0.082 | 2.255 |
| −2.217 | 0.148 | 2.255 |
| −2.071 | 0.212 | 2.255 |
| −1.923 | 0.273 | 2.255 |
| −1.774 | 0.331 | 2.255 |
| −1.624 | 0.387 | 2.255 |
| −1.473 | 0.439 | 2.255 |
| −1.321 | 0.488 | 2.255 |
| −1.168 | 0.533 | 2.255 |
| −1.013 | 0.573 | 2.255 |
| −0.858 | 0.610 | 2.255 |
| −0.701 | 0.641 | 2.255 |
| −0.543 | 0.668 | 2.255 |
| −0.385 | 0.690 | 2.255 |
| −0.226 | 0.706 | 2.255 |
| −0.066 | 0.716 | 2.255 |
| 0.093 | 0.722 | 2.255 |
| 0.253 | 0.721 | 2.255 |
| 0.413 | 0.714 | 2.255 |
| 0.572 | 0.702 | 2.255 |
| 0.731 | 0.683 | 2.255 |
| 0.889 | 0.657 | 2.255 |
| 1.045 | 0.626 | 2.255 |
| 1.201 | 0.587 | 2.255 |
| 1.354 | 0.543 | 2.255 |
| 1.505 | 0.491 | 2.255 |
| 1.654 | 0.433 | 2.255 |
| 1.801 | 0.369 | 2.255 |
| 1.944 | 0.298 | 2.255 |
| 2.084 | 0.221 | 2.255 |
| 2.221 | 0.138 | 2.255 |
| 2.353 | 0.049 | 2.255 |
| 2.482 | −0.046 | 2.255 |
| 2.606 | −0.147 | 2.255 |
| 2.724 | −0.254 | 2.255 |
| 2.837 | −0.367 | 2.255 |
| 2.945 | −0.485 | 2.255 |
| 3.048 | −0.608 | 2.255 |
| 3.145 | −0.735 | 2.255 |
| 3.140 | −0.843 | 3.383 |
| 3.098 | −0.971 | 3.383 |
| 2.955 | −0.925 | 3.383 |
| 2.818 | −0.850 | 3.383 |
| 2.679 | −0.779 | 3.383 |
| 2.539 | −0.710 | 3.383 |
| 2.398 | −0.644 | 3.383 |
| 2.256 | −0.580 | 3.383 |
| 2.113 | −0.518 | 3.383 |
| 1.969 | −0.457 | 3.383 |
| 1.824 | −0.401 | 3.383 |
| 1.678 | −0.347 | 3.383 |
| 1.530 | −0.298 | 3.383 |
| 1.381 | −0.253 | 3.383 |

TABLE 1-continued

| X | Y | Z |
|---|---|---|
| 1.230 | −0.211 | 3.383 |
| 1.079 | −0.174 | 3.383 |
| 0.926 | −0.142 | 3.383 |
| 0.773 | −0.114 | 3.383 |
| 0.619 | −0.090 | 3.383 |
| 0.464 | −0.071 | 3.383 |
| 0.309 | −0.055 | 3.383 |
| 0.154 | −0.043 | 3.383 |
| −0.002 | −0.035 | 3.383 |
| −0.158 | −0.031 | 3.383 |
| −0.314 | −0.031 | 3.383 |
| −0.470 | −0.034 | 3.383 |
| −0.625 | −0.041 | 3.383 |
| −0.781 | −0.051 | 3.383 |
| −0.936 | −0.065 | 3.383 |
| −1.091 | −0.082 | 3.383 |
| −1.246 | −0.103 | 3.383 |
| −1.399 | −0.128 | 3.383 |
| −1.553 | −0.157 | 3.383 |
| −1.705 | −0.189 | 3.383 |
| −1.857 | −0.224 | 3.383 |
| −2.008 | −0.263 | 3.383 |
| −2.158 | −0.306 | 3.383 |
| −2.307 | −0.352 | 3.383 |
| −2.455 | −0.402 | 3.383 |
| −2.601 | −0.455 | 3.383 |
| −2.747 | −0.511 | 3.383 |
| −2.891 | −0.570 | 3.383 |
| −3.034 | −0.633 | 3.383 |
| −3.175 | −0.698 | 3.383 |
| −3.315 | −0.767 | 3.383 |
| −3.454 | −0.838 | 3.383 |
| −3.591 | −0.912 | 3.383 |
| −3.728 | −0.987 | 3.383 |
| −3.870 | −1.032 | 3.383 |
| −3.898 | −0.903 | 3.383 |
| −3.776 | −0.807 | 3.383 |
| −3.650 | −0.715 | 3.383 |
| −3.522 | −0.626 | 3.383 |
| −3.392 | −0.540 | 3.383 |
| −3.261 | −0.456 | 3.383 |
| −3.128 | −0.374 | 3.383 |
| −2.995 | −0.293 | 3.383 |
| −2.860 | −0.215 | 3.383 |
| −2.724 | −0.139 | 3.383 |
| −2.586 | −0.065 | 3.383 |
| −2.448 | 0.006 | 3.383 |
| −2.308 | 0.076 | 3.383 |
| −2.168 | 0.143 | 3.383 |
| −2.026 | 0.208 | 3.383 |
| −1.883 | 0.270 | 3.383 |
| −1.738 | 0.329 | 3.383 |
| −1.593 | 0.384 | 3.383 |
| −1.446 | 0.437 | 3.383 |
| −1.298 | 0.486 | 3.383 |
| −1.149 | 0.531 | 3.383 |
| −0.999 | 0.573 | 3.383 |
| −0.847 | 0.610 | 3.383 |
| −0.695 | 0.642 | 3.383 |
| −0.541 | 0.669 | 3.383 |
| −0.387 | 0.691 | 3.383 |
| −0.232 | 0.707 | 3.383 |
| −0.076 | 0.717 | 3.383 |
| 0.080 | 0.722 | 3.383 |
| 0.235 | 0.721 | 3.383 |
| 0.391 | 0.714 | 3.383 |
| 0.546 | 0.700 | 3.383 |
| 0.701 | 0.680 | 3.383 |
| 0.855 | 0.654 | 3.383 |
| 1.007 | 0.621 | 3.383 |
| 1.158 | 0.582 | 3.383 |
| 1.307 | 0.537 | 3.383 |
| 1.454 | 0.486 | 3.383 |
| 1.599 | 0.428 | 3.383 |
| 1.742 | 0.365 | 3.383 |
| 1.881 | 0.295 | 3.383 |
| 2.018 | 0.220 | 3.383 |
| 2.150 | 0.138 | 3.383 |

TABLE 1-continued

| X | Y | Z |
|---|---|---|
| 2.280 | 0.051 | 3.383 |
| 2.405 | −0.042 | 3.383 |
| 2.525 | −0.141 | 3.383 |
| 2.640 | −0.246 | 3.383 |
| 2.750 | −0.357 | 3.383 |
| 2.855 | −0.472 | 3.383 |
| 2.955 | −0.592 | 3.383 |
| 3.049 | −0.716 | 3.383 |
| 3.036 | −0.800 | 4.510 |
| 2.991 | −0.921 | 4.510 |
| 2.852 | −0.873 | 4.510 |
| 2.718 | −0.804 | 4.510 |
| 2.582 | −0.737 | 4.510 |
| 2.445 | −0.672 | 4.510 |
| 2.307 | −0.610 | 4.510 |
| 2.169 | −0.549 | 4.510 |
| 2.030 | −0.489 | 4.510 |
| 1.890 | −0.431 | 4.510 |
| 1.749 | −0.375 | 4.510 |
| 1.607 | −0.323 | 4.510 |
| 1.464 | −0.275 | 4.510 |
| 1.319 | −0.230 | 4.510 |
| 1.173 | −0.189 | 4.510 |
| 1.026 | −0.153 | 4.510 |
| 0.878 | −0.122 | 4.510 |
| 0.729 | −0.096 | 4.510 |
| 0.579 | −0.073 | 4.510 |
| 0.429 | −0.055 | 4.510 |
| 0.278 | −0.040 | 4.510 |
| 0.127 | −0.030 | 4.510 |
| −0.024 | −0.023 | 4.510 |
| −0.175 | −0.020 | 4.510 |
| −0.326 | −0.021 | 4.510 |
| −0.478 | −0.026 | 4.510 |
| −0.629 | −0.034 | 4.510 |
| −0.780 | −0.046 | 4.510 |
| −0.930 | −0.061 | 4.510 |
| −1.080 | −0.081 | 4.510 |
| −1.230 | −0.104 | 4.510 |
| −1.379 | −0.131 | 4.510 |
| −1.527 | −0.162 | 4.510 |
| −1.674 | −0.196 | 4.510 |
| −1.821 | −0.234 | 4.510 |
| −1.967 | −0.275 | 4.510 |
| −2.111 | −0.320 | 4.510 |
| −2.255 | −0.367 | 4.510 |
| −2.398 | −0.418 | 4.510 |
| −2.539 | −0.471 | 4.510 |
| −2.680 | −0.528 | 4.510 |
| −2.819 | −0.588 | 4.510 |
| −2.957 | −0.650 | 4.510 |
| −3.093 | −0.715 | 4.510 |
| −3.229 | −0.782 | 4.510 |
| −3.363 | −0.852 | 4.510 |
| −3.496 | −0.924 | 4.510 |
| −3.628 | −0.999 | 4.510 |
| −3.767 | −1.029 | 4.510 |
| −3.782 | −0.899 | 4.510 |
| −3.661 | −0.809 | 4.510 |
| −3.537 | −0.721 | 4.510 |
| −3.413 | −0.635 | 4.510 |
| −3.287 | −0.551 | 4.510 |
| −3.160 | −0.469 | 4.510 |
| −3.032 | −0.388 | 4.510 |
| −2.903 | −0.309 | 4.510 |
| −2.772 | −0.232 | 4.510 |
| −2.641 | −0.157 | 4.510 |
| −2.509 | −0.083 | 4.510 |
| −2.375 | −0.012 | 4.510 |
| −2.241 | 0.058 | 4.510 |
| −2.106 | 0.125 | 4.510 |
| −1.969 | 0.190 | 4.510 |
| −1.831 | 0.252 | 4.510 |
| −1.692 | 0.312 | 4.510 |
| −1.551 | 0.368 | 4.510 |
| −1.410 | 0.422 | 4.510 |
| −1.267 | 0.471 | 4.510 |
| −1.122 | 0.518 | 4.510 |

TABLE 1-continued

| X | Y | Z |
|---|---|---|
| −0.977 | 0.560 | 4.510 |
| −0.831 | 0.598 | 4.510 |
| −0.683 | 0.631 | 4.510 |
| −0.534 | 0.660 | 4.510 |
| −0.385 | 0.683 | 4.510 |
| −0.234 | 0.701 | 4.510 |
| −0.084 | 0.712 | 4.510 |
| 0.068 | 0.719 | 4.510 |
| 0.219 | 0.719 | 4.510 |
| 0.370 | 0.713 | 4.510 |
| 0.521 | 0.700 | 4.510 |
| 0.671 | 0.681 | 4.510 |
| 0.820 | 0.656 | 4.510 |
| 0.968 | 0.624 | 4.510 |
| 1.115 | 0.586 | 4.510 |
| 1.260 | 0.542 | 4.510 |
| 1.403 | 0.493 | 4.510 |
| 1.544 | 0.437 | 4.510 |
| 1.682 | 0.376 | 4.510 |
| 1.817 | 0.309 | 4.510 |
| 1.950 | 0.235 | 4.510 |
| 2.079 | 0.156 | 4.510 |
| 2.204 | 0.071 | 4.510 |
| 2.326 | −0.019 | 4.510 |
| 2.442 | −0.116 | 4.510 |
| 2.554 | −0.218 | 4.510 |
| 2.660 | −0.326 | 4.510 |
| 2.761 | −0.439 | 4.510 |
| 2.857 | −0.555 | 4.510 |
| 2.949 | −0.676 | 4.510 |
| 2.904 | −0.724 | 5.638 |
| 2.857 | −0.839 | 5.638 |
| 2.722 | −0.790 | 5.638 |
| 2.591 | −0.727 | 5.638 |
| 2.458 | −0.665 | 5.638 |
| 2.325 | −0.604 | 5.638 |
| 2.192 | −0.545 | 5.638 |
| 2.058 | −0.487 | 5.638 |
| 1.923 | −0.431 | 5.638 |
| 1.787 | −0.377 | 5.638 |
| 1.651 | −0.325 | 5.638 |
| 1.513 | −0.276 | 5.638 |
| 1.374 | −0.231 | 5.638 |
| 1.234 | −0.190 | 5.638 |
| 1.093 | −0.152 | 5.638 |
| 0.950 | −0.119 | 5.638 |
| 0.807 | −0.091 | 5.638 |
| 0.663 | −0.067 | 5.638 |
| 0.518 | −0.047 | 5.638 |
| 0.373 | −0.031 | 5.638 |
| 0.228 | −0.020 | 5.638 |
| 0.082 | −0.012 | 5.638 |
| −0.064 | −0.008 | 5.638 |
| −0.210 | −0.008 | 5.638 |
| −0.356 | −0.012 | 5.638 |
| −0.502 | −0.020 | 5.638 |
| −0.648 | −0.031 | 5.638 |
| −0.793 | −0.046 | 5.638 |
| −0.938 | −0.065 | 5.638 |
| −1.082 | −0.088 | 5.638 |
| −1.226 | −0.114 | 5.638 |
| −1.369 | −0.144 | 5.638 |
| −1.511 | −0.178 | 5.638 |
| −1.652 | −0.215 | 5.638 |
| −1.793 | −0.256 | 5.638 |
| −1.932 | −0.299 | 5.638 |
| −2.071 | −0.346 | 5.638 |
| −2.208 | −0.396 | 5.638 |
| −2.344 | −0.448 | 5.638 |
| −2.480 | −0.503 | 5.638 |
| −2.614 | −0.560 | 5.638 |
| −2.747 | −0.620 | 5.638 |
| −2.880 | −0.682 | 5.638 |
| −3.011 | −0.746 | 5.638 |
| −3.141 | −0.812 | 5.638 |
| −3.270 | −0.881 | 5.638 |
| −3.399 | −0.950 | 5.638 |
| −3.526 | −1.021 | 5.638 |

TABLE 1-continued

| X | Y | Z |
|---|---|---|
| −3.661 | −1.045 | 5.638 |
| −3.666 | −0.918 | 5.638 |
| −3.548 | −0.832 | 5.638 |
| −3.429 | −0.747 | 5.638 |
| −3.308 | −0.665 | 5.638 |
| −3.186 | −0.584 | 5.638 |
| −3.064 | −0.505 | 5.638 |
| −2.940 | −0.427 | 5.638 |
| −2.816 | −0.350 | 5.638 |
| −2.691 | −0.275 | 5.638 |
| −2.565 | −0.201 | 5.638 |
| −2.438 | −0.129 | 5.638 |
| −2.310 | −0.058 | 5.638 |
| −2.181 | 0.011 | 5.638 |
| −2.051 | 0.078 | 5.638 |
| −1.920 | 0.142 | 5.638 |
| −1.788 | 0.205 | 5.638 |
| −1.655 | 0.265 | 5.638 |
| −1.521 | 0.322 | 5.638 |
| −1.385 | 0.377 | 5.638 |
| −1.249 | 0.429 | 5.638 |
| −1.111 | 0.477 | 5.638 |
| −0.972 | 0.522 | 5.638 |
| −0.831 | 0.562 | 5.638 |
| −0.690 | 0.598 | 5.638 |
| −0.547 | 0.630 | 5.638 |
| −0.404 | 0.656 | 5.638 |
| −0.259 | 0.678 | 5.638 |
| −0.114 | 0.693 | 5.638 |
| 0.032 | 0.703 | 5.638 |
| 0.178 | 0.707 | 5.638 |
| 0.324 | 0.705 | 5.638 |
| 0.470 | 0.696 | 5.638 |
| 0.615 | 0.682 | 5.638 |
| 0.760 | 0.661 | 5.638 |
| 0.903 | 0.633 | 5.638 |
| 1.045 | 0.600 | 5.638 |
| 1.186 | 0.560 | 5.638 |
| 1.325 | 0.514 | 5.638 |
| 1.461 | 0.463 | 5.638 |
| 1.596 | 0.405 | 5.638 |
| 1.727 | 0.342 | 5.638 |
| 1.856 | 0.272 | 5.638 |
| 1.981 | 0.197 | 5.638 |
| 2.102 | 0.116 | 5.638 |
| 2.220 | 0.029 | 5.638 |
| 2.333 | −0.064 | 5.638 |
| 2.441 | −0.162 | 5.638 |
| 2.544 | −0.265 | 5.638 |
| 2.642 | −0.374 | 5.638 |
| 2.734 | −0.487 | 5.638 |
| 2.822 | −0.604 | 5.638 |
| 2.759 | −0.622 | 6.765 |
| 2.711 | −0.731 | 6.765 |
| 2.580 | −0.686 | 6.765 |
| 2.452 | −0.628 | 6.765 |
| 2.324 | −0.570 | 6.765 |
| 2.195 | −0.514 | 6.765 |
| 2.066 | −0.458 | 6.765 |
| 1.936 | −0.405 | 6.765 |
| 1.806 | −0.353 | 6.765 |
| 1.674 | −0.303 | 6.765 |
| 1.542 | −0.256 | 6.765 |
| 1.409 | −0.212 | 6.765 |
| 1.274 | −0.171 | 6.765 |
| 1.138 | −0.134 | 6.765 |
| 1.002 | −0.102 | 6.765 |
| 0.864 | −0.074 | 6.765 |
| 0.726 | −0.050 | 6.765 |
| 0.587 | −0.030 | 6.765 |
| 0.447 | −0.014 | 6.765 |
| 0.307 | −0.003 | 6.765 |
| 0.167 | 0.004 | 6.765 |
| 0.026 | 0.006 | 6.765 |
| −0.114 | 0.005 | 6.765 |
| −0.255 | 0.000 | 6.765 |
| −0.395 | −0.009 | 6.765 |
| −0.535 | −0.021 | 6.765 |

TABLE 1-continued

| X | Y | Z |
|---|---|---|
| −0.675 | −0.037 | 6.765 |
| −0.814 | −0.056 | 6.765 |
| −0.952 | −0.079 | 6.765 |
| −1.090 | −0.106 | 6.765 |
| −1.228 | −0.136 | 6.765 |
| −1.364 | −0.170 | 6.765 |
| −1.499 | −0.208 | 6.765 |
| −1.634 | −0.249 | 6.765 |
| −1.767 | −0.292 | 6.765 |
| −1.900 | −0.339 | 6.765 |
| −2.032 | −0.388 | 6.765 |
| −2.162 | −0.439 | 6.765 |
| −2.292 | −0.493 | 6.765 |
| −2.421 | −0.549 | 6.765 |
| −2.549 | −0.607 | 6.765 |
| −2.676 | −0.667 | 6.765 |
| −2.802 | −0.730 | 6.765 |
| −2.926 | −0.794 | 6.765 |
| −3.051 | −0.860 | 6.765 |
| −3.175 | −0.926 | 6.765 |
| −3.298 | −0.993 | 6.765 |
| −3.422 | −1.060 | 6.765 |
| −3.551 | −1.080 | 6.765 |
| −3.548 | −0.960 | 6.765 |
| −3.435 | −0.875 | 6.765 |
| −3.321 | −0.794 | 6.765 |
| −3.205 | −0.715 | 6.765 |
| −3.088 | −0.637 | 6.765 |
| −2.969 | −0.561 | 6.765 |
| −2.851 | −0.486 | 6.765 |
| −2.732 | −0.412 | 6.765 |
| −2.612 | −0.338 | 6.765 |
| −2.491 | −0.266 | 6.765 |
| −2.370 | −0.195 | 6.765 |
| −2.248 | −0.126 | 6.765 |
| −2.125 | −0.058 | 6.765 |
| −2.001 | 0.008 | 6.765 |
| −1.876 | 0.073 | 6.765 |
| −1.750 | 0.135 | 6.765 |
| −1.624 | 0.196 | 6.765 |
| −1.496 | 0.255 | 6.765 |
| −1.368 | 0.312 | 6.765 |
| −1.238 | 0.366 | 6.765 |
| −1.107 | 0.418 | 6.765 |
| −0.975 | 0.466 | 6.765 |
| −0.842 | 0.510 | 6.765 |
| −0.707 | 0.550 | 6.765 |
| −0.571 | 0.586 | 6.765 |
| −0.434 | 0.618 | 6.765 |
| −0.296 | 0.644 | 6.765 |
| −0.157 | 0.665 | 6.765 |
| −0.018 | 0.681 | 6.765 |
| 0.122 | 0.690 | 6.765 |
| 0.263 | 0.694 | 6.765 |
| 0.403 | 0.692 | 6.765 |
| 0.544 | 0.684 | 6.765 |
| 0.683 | 0.670 | 6.765 |
| 0.822 | 0.650 | 6.765 |
| 0.960 | 0.623 | 6.765 |
| 1.097 | 0.590 | 6.765 |
| 1.232 | 0.551 | 6.765 |
| 1.364 | 0.505 | 6.765 |
| 1.495 | 0.453 | 6.765 |
| 1.623 | 0.394 | 6.765 |
| 1.748 | 0.330 | 6.765 |
| 1.869 | 0.260 | 6.765 |
| 1.987 | 0.183 | 6.765 |
| 2.101 | 0.102 | 6.765 |
| 2.211 | 0.014 | 6.765 |
| 2.316 | −0.080 | 6.765 |
| 2.416 | −0.178 | 6.765 |
| 2.510 | −0.283 | 6.765 |
| 2.599 | −0.392 | 6.765 |
| 2.682 | −0.505 | 6.765 |
| 2.618 | −0.502 | 7.893 |
| 2.572 | −0.609 | 7.893 |
| 2.446 | −0.570 | 7.893 |
| 2.322 | −0.516 | 7.893 |

TABLE 1-continued

| X | Y | Z |
|---|---|---|
| 2.198 | −0.463 | 7.893 |
| 2.073 | −0.411 | 7.893 |
| 1.948 | −0.360 | 7.893 |
| 1.822 | −0.311 | 7.893 |
| 1.696 | −0.262 | 7.893 |
| 1.569 | −0.217 | 7.893 |
| 1.441 | −0.174 | 7.893 |
| 1.311 | −0.136 | 7.893 |
| 1.181 | −0.101 | 7.893 |
| 1.049 | −0.070 | 7.893 |
| 0.917 | −0.043 | 7.893 |
| 0.783 | −0.021 | 7.893 |
| 0.650 | −0.003 | 7.893 |
| 0.515 | 0.011 | 7.893 |
| 0.380 | 0.020 | 7.893 |
| 0.245 | 0.025 | 7.893 |
| 0.110 | 0.025 | 7.893 |
| −0.025 | 0.021 | 7.893 |
| −0.160 | 0.013 | 7.893 |
| −0.294 | 0.001 | 7.893 |
| −0.429 | −0.013 | 7.893 |
| −0.562 | −0.032 | 7.893 |
| −0.696 | −0.054 | 7.893 |
| −0.828 | −0.079 | 7.893 |
| −0.960 | −0.108 | 7.893 |
| −1.092 | −0.140 | 7.893 |
| −1.222 | −0.175 | 7.893 |
| −1.352 | −0.214 | 7.893 |
| −1.480 | −0.255 | 7.893 |
| −1.608 | −0.300 | 7.893 |
| −1.734 | −0.347 | 7.893 |
| −1.860 | −0.396 | 7.893 |
| −1.985 | −0.448 | 7.893 |
| −2.109 | −0.501 | 7.893 |
| −2.232 | −0.557 | 7.893 |
| −2.355 | −0.614 | 7.893 |
| −2.476 | −0.673 | 7.893 |
| −2.597 | −0.733 | 7.893 |
| −2.717 | −0.795 | 7.893 |
| −2.837 | −0.858 | 7.893 |
| −2.955 | −0.922 | 7.893 |
| −3.074 | −0.987 | 7.893 |
| −3.192 | −1.053 | 7.893 |
| −3.310 | −1.119 | 7.893 |
| −3.433 | −1.132 | 7.893 |
| −3.426 | −1.015 | 7.893 |
| −3.317 | −0.935 | 7.893 |
| −3.207 | −0.856 | 7.893 |
| −3.096 | −0.780 | 7.893 |
| −2.984 | −0.705 | 7.893 |
| −2.870 | −0.631 | 7.893 |
| −2.757 | −0.558 | 7.893 |
| −2.643 | −0.486 | 7.893 |
| −2.528 | −0.414 | 7.893 |
| −2.413 | −0.344 | 7.893 |
| −2.297 | −0.274 | 7.893 |
| −2.181 | −0.206 | 7.893 |
| −2.063 | −0.138 | 7.893 |
| −1.946 | −0.072 | 7.893 |
| −1.827 | −0.007 | 7.893 |
| −1.708 | 0.056 | 7.893 |
| −1.588 | 0.118 | 7.893 |
| −1.467 | 0.179 | 7.893 |
| −1.345 | 0.238 | 7.893 |
| −1.223 | 0.294 | 7.893 |
| −1.099 | 0.349 | 7.893 |
| −0.974 | 0.401 | 7.893 |
| −0.848 | 0.449 | 7.893 |
| −0.721 | 0.495 | 7.893 |
| −0.593 | 0.536 | 7.893 |
| −0.463 | 0.573 | 7.893 |
| −0.332 | 0.606 | 7.893 |
| −0.200 | 0.634 | 7.893 |
| −0.066 | 0.657 | 7.893 |
| 0.068 | 0.674 | 7.893 |
| 0.202 | 0.685 | 7.893 |
| 0.337 | 0.691 | 7.893 |
| 0.472 | 0.691 | 7.893 |

TABLE 1-continued

| X | Y | Z |
|---|---|---|
| 0.607 | 0.686 | 7.893 |
| 0.742 | 0.673 | 7.893 |
| 0.876 | 0.655 | 7.893 |
| 1.008 | 0.630 | 7.893 |
| 1.140 | 0.598 | 7.893 |
| 1.269 | 0.560 | 7.893 |
| 1.397 | 0.515 | 7.893 |
| 1.522 | 0.464 | 7.893 |
| 1.644 | 0.406 | 7.893 |
| 1.763 | 0.342 | 7.893 |
| 1.878 | 0.272 | 7.893 |
| 1.989 | 0.195 | 7.893 |
| 2.096 | 0.113 | 7.893 |
| 2.198 | 0.024 | 7.893 |
| 2.294 | −0.071 | 7.893 |
| 2.384 | −0.172 | 7.893 |
| 2.468 | −0.277 | 7.893 |
| 2.546 | −0.388 | 7.893 |
| 2.484 | −0.359 | 9.020 |
| 2.445 | −0.465 | 9.020 |
| 2.322 | −0.436 | 9.020 |
| 2.202 | −0.387 | 9.020 |
| 2.081 | −0.339 | 9.020 |
| 1.960 | −0.293 | 9.020 |
| 1.839 | −0.248 | 9.020 |
| 1.717 | −0.203 | 9.020 |
| 1.594 | −0.161 | 9.020 |
| 1.471 | −0.121 | 9.020 |
| 1.347 | −0.084 | 9.020 |
| 1.221 | −0.052 | 9.020 |
| 1.095 | −0.023 | 9.020 |
| 0.967 | 0.001 | 9.020 |
| 0.839 | 0.021 | 9.020 |
| 0.710 | 0.036 | 9.020 |
| 0.581 | 0.047 | 9.020 |
| 0.452 | 0.053 | 9.020 |
| 0.322 | 0.054 | 9.020 |
| 0.192 | 0.051 | 9.020 |
| 0.063 | 0.043 | 9.020 |
| −0.066 | 0.032 | 9.020 |
| −0.195 | 0.016 | 9.020 |
| −0.323 | −0.002 | 9.020 |
| −0.451 | −0.025 | 9.020 |
| −0.578 | −0.050 | 9.020 |
| −0.704 | −0.079 | 9.020 |
| −0.830 | −0.111 | 9.020 |
| −0.955 | −0.146 | 9.020 |
| −1.079 | −0.184 | 9.020 |
| −1.202 | −0.225 | 9.020 |
| −1.324 | −0.269 | 9.020 |
| −1.445 | −0.316 | 9.020 |
| −1.565 | −0.364 | 9.020 |
| −1.684 | −0.415 | 9.020 |
| −1.803 | −0.467 | 9.020 |
| −1.921 | −0.521 | 9.020 |
| −2.038 | −0.577 | 9.020 |
| −2.154 | −0.633 | 9.020 |
| −2.270 | −0.692 | 9.020 |
| −2.386 | −0.751 | 9.020 |
| −2.500 | −0.812 | 9.020 |
| −2.614 | −0.873 | 9.020 |
| −2.728 | −0.936 | 9.020 |
| −2.841 | −0.999 | 9.020 |
| −2.954 | −1.062 | 9.020 |
| −3.067 | −1.127 | 9.020 |
| −3.179 | −1.191 | 9.020 |
| −3.297 | −1.201 | 9.020 |
| −3.293 | −1.087 | 9.020 |
| −3.188 | −1.010 | 9.020 |
| −3.083 | −0.935 | 9.020 |
| −2.976 | −0.861 | 9.020 |
| −2.869 | −0.788 | 9.020 |
| −2.761 | −0.716 | 9.020 |
| −2.653 | −0.645 | 9.020 |
| −2.544 | −0.574 | 9.020 |
| −2.435 | −0.504 | 9.020 |
| −2.326 | −0.435 | 9.020 |
| −2.216 | −0.366 | 9.020 |

TABLE 1-continued

| X | Y | Z |
|---|---|---|
| −2.105 | −0.298 | 9.020 |
| −1.995 | −0.231 | 9.020 |
| −1.883 | −0.164 | 9.020 |
| −1.771 | −0.099 | 9.020 |
| −1.659 | −0.034 | 9.020 |
| −1.546 | 0.029 | 9.020 |
| −1.432 | 0.091 | 9.020 |
| −1.318 | 0.152 | 9.020 |
| −1.202 | 0.212 | 9.020 |
| −1.086 | 0.269 | 9.020 |
| −0.969 | 0.325 | 9.020 |
| −0.851 | 0.378 | 9.020 |
| −0.731 | 0.428 | 9.020 |
| −0.611 | 0.476 | 9.020 |
| −0.488 | 0.519 | 9.020 |
| −0.365 | 0.559 | 9.020 |
| −0.240 | 0.594 | 9.020 |
| −0.114 | 0.625 | 9.020 |
| 0.013 | 0.651 | 9.020 |
| 0.141 | 0.671 | 9.020 |
| 0.270 | 0.686 | 9.020 |
| 0.399 | 0.695 | 9.020 |
| 0.528 | 0.699 | 9.020 |
| 0.658 | 0.696 | 9.020 |
| 0.787 | 0.687 | 9.020 |
| 0.916 | 0.672 | 9.020 |
| 1.044 | 0.650 | 9.020 |
| 1.170 | 0.621 | 9.020 |
| 1.295 | 0.585 | 9.020 |
| 1.417 | 0.543 | 9.020 |
| 1.537 | 0.493 | 9.020 |
| 1.654 | 0.437 | 9.020 |
| 1.767 | 0.374 | 9.020 |
| 1.877 | 0.305 | 9.020 |
| 1.982 | 0.229 | 9.020 |
| 2.082 | 0.146 | 9.020 |
| 2.175 | 0.056 | 9.020 |
| 2.262 | −0.040 | 9.020 |
| 2.343 | −0.141 | 9.020 |
| 2.417 | −0.248 | 9.020 |
| 2.358 | −0.185 | 10.148 |
| 2.326 | −0.291 | 10.148 |
| 2.208 | −0.273 | 10.148 |
| 2.091 | −0.232 | 10.148 |
| 1.974 | −0.193 | 10.148 |
| 1.856 | −0.154 | 10.148 |
| 1.738 | −0.117 | 10.148 |
| 1.619 | −0.080 | 10.148 |
| 1.500 | −0.046 | 10.148 |
| 1.380 | −0.014 | 10.148 |
| 1.260 | 0.014 | 10.148 |
| 1.138 | 0.039 | 10.148 |
| 1.016 | 0.059 | 10.148 |
| 0.893 | 0.075 | 10.148 |
| 0.770 | 0.086 | 10.148 |
| 0.646 | 0.093 | 10.148 |
| 0.522 | 0.095 | 10.148 |
| 0.398 | 0.093 | 10.148 |
| 0.274 | 0.086 | 10.148 |
| 0.151 | 0.075 | 10.148 |
| 0.028 | 0.060 | 10.148 |
| −0.095 | 0.042 | 10.148 |
| −0.217 | 0.019 | 10.148 |
| −0.338 | −0.007 | 10.148 |
| −0.458 | −0.037 | 10.148 |
| −0.578 | −0.069 | 10.148 |
| −0.696 | −0.105 | 10.148 |
| −0.814 | −0.144 | 10.148 |
| −0.930 | −0.186 | 10.148 |
| −1.046 | −0.231 | 10.148 |
| −1.161 | −0.278 | 10.148 |
| −1.275 | −0.327 | 10.148 |
| −1.388 | −0.378 | 10.148 |
| −1.500 | −0.431 | 10.148 |
| −1.611 | −0.485 | 10.148 |
| −1.722 | −0.541 | 10.148 |
| −1.832 | −0.598 | 10.148 |
| −1.942 | −0.656 | 10.148 |

TABLE 1-continued

| X | Y | Z |
|---|---|---|
| −2.051 | −0.714 | 10.148 |
| −2.159 | −0.774 | 10.148 |
| −2.267 | −0.835 | 10.148 |
| −2.375 | −0.896 | 10.148 |
| −2.483 | −0.957 | 10.148 |
| −2.590 | −1.019 | 10.148 |
| −2.698 | −1.081 | 10.148 |
| −2.805 | −1.143 | 10.148 |
| −2.912 | −1.205 | 10.148 |
| −3.020 | −1.266 | 10.148 |
| −3.134 | −1.286 | 10.148 |
| −3.143 | −1.178 | 10.148 |
| −3.045 | −1.102 | 10.148 |
| −2.945 | −1.029 | 10.148 |
| −2.844 | −0.957 | 10.148 |
| −2.742 | −0.886 | 10.148 |
| −2.640 | −0.816 | 10.148 |
| −2.538 | −0.747 | 10.148 |
| −2.435 | −0.677 | 10.148 |
| −2.332 | −0.608 | 10.148 |
| −2.229 | −0.539 | 10.148 |
| −2.125 | −0.471 | 10.148 |
| −2.022 | −0.403 | 10.148 |
| −1.917 | −0.336 | 10.148 |
| −1.813 | −0.269 | 10.148 |
| −1.708 | −0.203 | 10.148 |
| −1.603 | −0.137 | 10.148 |
| −1.498 | −0.073 | 10.148 |
| −1.391 | −0.009 | 10.148 |
| −1.285 | 0.054 | 10.148 |
| −1.177 | 0.116 | 10.148 |
| −1.069 | 0.176 | 10.148 |
| −0.960 | 0.235 | 10.148 |
| −0.850 | 0.292 | 10.148 |
| −0.739 | 0.347 | 10.148 |
| −0.626 | 0.400 | 10.148 |
| −0.513 | 0.449 | 10.148 |
| −0.398 | 0.496 | 10.148 |
| −0.282 | 0.539 | 10.148 |
| −0.164 | 0.578 | 10.148 |
| −0.045 | 0.613 | 10.148 |
| 0.075 | 0.643 | 10.148 |
| 0.196 | 0.668 | 10.148 |
| 0.319 | 0.687 | 10.148 |
| 0.442 | 0.701 | 10.148 |
| 0.566 | 0.709 | 10.148 |
| 0.690 | 0.711 | 10.148 |
| 0.813 | 0.707 | 10.148 |
| 0.937 | 0.696 | 10.148 |
| 1.059 | 0.678 | 10.148 |
| 1.181 | 0.653 | 10.148 |
| 1.301 | 0.622 | 10.148 |
| 1.419 | 0.583 | 10.148 |
| 1.534 | 0.537 | 10.148 |
| 1.646 | 0.485 | 10.148 |
| 1.754 | 0.425 | 10.148 |
| 1.859 | 0.358 | 10.148 |
| 1.958 | 0.284 | 10.148 |
| 2.051 | 0.202 | 10.148 |
| 2.138 | 0.114 | 10.148 |
| 2.219 | 0.020 | 10.148 |
| 2.292 | −0.080 | 10.148 |
| 2.245 | 0.008 | 11.275 |
| 2.222 | −0.096 | 11.275 |
| 2.108 | −0.090 | 11.275 |
| 1.993 | −0.060 | 11.275 |
| 1.879 | −0.031 | 11.275 |
| 1.764 | −0.002 | 11.275 |
| 1.649 | 0.027 | 11.275 |
| 1.534 | 0.053 | 11.275 |
| 1.418 | 0.078 | 11.275 |
| 1.302 | 0.100 | 11.275 |
| 1.185 | 0.118 | 11.275 |
| 1.067 | 0.133 | 11.275 |
| 0.949 | 0.144 | 11.275 |
| 0.831 | 0.150 | 11.275 |
| 0.713 | 0.152 | 11.275 |
| 0.594 | 0.150 | 11.275 |

TABLE 1-continued

| X | Y | Z |
|---|---|---|
| 0.476 | 0.143 | 11.275 |
| 0.358 | 0.132 | 11.275 |
| 0.241 | 0.118 | 11.275 |
| 0.124 | 0.100 | 11.275 |
| 0.007 | 0.078 | 11.275 |
| −0.108 | 0.052 | 11.275 |
| −0.223 | 0.023 | 11.275 |
| −0.337 | −0.010 | 11.275 |
| −0.449 | −0.046 | 11.275 |
| −0.561 | −0.086 | 11.275 |
| −0.672 | −0.128 | 11.275 |
| −0.781 | −0.173 | 11.275 |
| −0.889 | −0.221 | 11.275 |
| −0.997 | −0.271 | 11.275 |
| −1.103 | −0.323 | 11.275 |
| −1.209 | −0.376 | 11.275 |
| −1.313 | −0.432 | 11.275 |
| −1.417 | −0.488 | 11.275 |
| −1.521 | −0.546 | 11.275 |
| −1.623 | −0.605 | 11.275 |
| −1.726 | −0.664 | 11.275 |
| −1.828 | −0.725 | 11.275 |
| −1.929 | −0.786 | 11.275 |
| −2.030 | −0.847 | 11.275 |
| −2.131 | −0.909 | 11.275 |
| −2.232 | −0.971 | 11.275 |
| −2.333 | −1.033 | 11.275 |
| −2.434 | −1.095 | 11.275 |
| −2.535 | −1.157 | 11.275 |
| −2.636 | −1.218 | 11.275 |
| −2.738 | −1.278 | 11.275 |
| −2.841 | −1.337 | 11.275 |
| −2.949 | −1.374 | 11.275 |
| −2.986 | −1.278 | 11.275 |
| −2.896 | −1.202 | 11.275 |
| −2.803 | −1.129 | 11.275 |
| −2.707 | −1.059 | 11.275 |
| −2.611 | −0.990 | 11.275 |
| −2.515 | −0.921 | 11.275 |
| −2.418 | −0.853 | 11.275 |
| −2.322 | −0.784 | 11.275 |
| −2.225 | −0.716 | 11.275 |
| −2.128 | −0.647 | 11.275 |
| −2.032 | −0.579 | 11.275 |
| −1.934 | −0.512 | 11.275 |
| −1.837 | −0.444 | 11.275 |
| −1.740 | −0.377 | 11.275 |
| −1.642 | −0.310 | 11.275 |
| −1.544 | −0.244 | 11.275 |
| −1.446 | −0.177 | 11.275 |
| −1.347 | −0.112 | 11.275 |
| −1.248 | −0.047 | 11.275 |
| −1.148 | 0.016 | 11.275 |
| −1.048 | 0.079 | 11.275 |
| −0.947 | 0.140 | 11.275 |
| −0.844 | 0.200 | 11.275 |
| −0.742 | 0.259 | 11.275 |
| −0.638 | 0.316 | 11.275 |
| −0.533 | 0.370 | 11.275 |
| −0.426 | 0.423 | 11.275 |
| −0.319 | 0.472 | 11.275 |
| −0.210 | 0.519 | 11.275 |
| −0.100 | 0.562 | 11.275 |
| 0.012 | 0.601 | 11.275 |
| 0.125 | 0.635 | 11.275 |
| 0.240 | 0.665 | 11.275 |
| 0.356 | 0.689 | 11.275 |
| 0.473 | 0.708 | 11.275 |
| 0.590 | 0.721 | 11.275 |
| 0.708 | 0.728 | 11.275 |
| 0.827 | 0.729 | 11.275 |
| 0.945 | 0.724 | 11.275 |
| 1.063 | 0.711 | 11.275 |
| 1.180 | 0.692 | 11.275 |
| 1.295 | 0.666 | 11.275 |
| 1.409 | 0.633 | 11.275 |
| 1.520 | 0.593 | 11.275 |
| 1.628 | 0.545 | 11.275 |

TABLE 1-continued

| X | Y | Z |
|---|---|---|
| 1.733 | 0.490 | 11.275 |
| 1.833 | 0.427 | 11.275 |
| 1.929 | 0.357 | 11.275 |
| 2.019 | 0.280 | 11.275 |
| 2.102 | 0.196 | 11.275 |
| 2.177 | 0.105 | 11.275 |
| 2.151 | 0.204 | 12.403 |
| 2.135 | 0.104 | 12.403 |
| 2.026 | 0.100 | 12.403 |
| 1.914 | 0.118 | 12.403 |
| 1.802 | 0.136 | 12.403 |
| 1.690 | 0.155 | 12.403 |
| 1.578 | 0.173 | 12.403 |
| 1.465 | 0.189 | 12.403 |
| 1.353 | 0.203 | 12.403 |
| 1.240 | 0.214 | 12.403 |
| 1.127 | 0.222 | 12.403 |
| 1.013 | 0.227 | 12.403 |
| 0.900 | 0.227 | 12.403 |
| 0.786 | 0.224 | 12.403 |
| 0.673 | 0.216 | 12.403 |
| 0.560 | 0.205 | 12.403 |
| 0.448 | 0.190 | 12.403 |
| 0.336 | 0.172 | 12.403 |
| 0.225 | 0.149 | 12.403 |
| 0.114 | 0.124 | 12.403 |
| 0.005 | 0.095 | 12.403 |
| −0.104 | 0.063 | 12.403 |
| −0.212 | 0.027 | 12.403 |
| −0.319 | −0.011 | 12.403 |
| −0.424 | −0.053 | 12.403 |
| −0.529 | −0.098 | 12.403 |
| −0.632 | −0.145 | 12.403 |
| −0.734 | −0.194 | 12.403 |
| −0.835 | −0.246 | 12.403 |
| −0.935 | −0.300 | 12.403 |
| −1.034 | −0.355 | 12.403 |
| −1.132 | −0.412 | 12.403 |
| −1.230 | −0.470 | 12.403 |
| −1.326 | −0.529 | 12.403 |
| −1.423 | −0.589 | 12.403 |
| −1.518 | −0.650 | 12.403 |
| −1.614 | −0.711 | 12.403 |
| −1.709 | −0.773 | 12.403 |
| −1.803 | −0.836 | 12.403 |
| −1.898 | −0.899 | 12.403 |
| −1.992 | −0.962 | 12.403 |
| −2.086 | −1.025 | 12.403 |
| −2.180 | −1.089 | 12.403 |
| −2.275 | −1.152 | 12.403 |
| −2.369 | −1.214 | 12.403 |
| −2.464 | −1.276 | 12.403 |
| −2.560 | −1.337 | 12.403 |
| −2.656 | −1.397 | 12.403 |
| −2.756 | −1.449 | 12.403 |
| −2.827 | −1.379 | 12.403 |
| −2.755 | −1.296 | 12.403 |
| −2.666 | −1.225 | 12.403 |
| −2.577 | −1.155 | 12.403 |
| −2.486 | −1.087 | 12.403 |
| −2.396 | −1.019 | 12.403 |
| −2.305 | −0.951 | 12.403 |
| −2.214 | −0.883 | 12.403 |
| −2.123 | −0.814 | 12.403 |
| −2.033 | −0.746 | 12.403 |
| −1.942 | −0.678 | 12.403 |
| −1.851 | −0.611 | 12.403 |
| −1.760 | −0.543 | 12.403 |
| −1.669 | −0.475 | 12.403 |
| −1.577 | −0.408 | 12.403 |
| −1.486 | −0.341 | 12.403 |
| −1.394 | −0.274 | 12.403 |
| −1.302 | −0.208 | 12.403 |
| −1.210 | −0.142 | 12.403 |
| −1.117 | −0.077 | 12.403 |
| −1.023 | −0.013 | 12.403 |
| −0.929 | 0.050 | 12.403 |
| −0.834 | 0.113 | 12.403 |

TABLE 1-continued

| X | Y | Z |
|---|---|---|
| −0.738 | 0.173 | 12.403 |
| −0.642 | 0.233 | 12.403 |
| −0.544 | 0.291 | 12.403 |
| −0.446 | 0.347 | 12.403 |
| −0.346 | 0.402 | 12.403 |
| −0.245 | 0.453 | 12.403 |
| −0.143 | 0.502 | 12.403 |
| −0.039 | 0.548 | 12.403 |
| 0.067 | 0.589 | 12.403 |
| 0.174 | 0.627 | 12.403 |
| 0.282 | 0.661 | 12.403 |
| 0.392 | 0.690 | 12.403 |
| 0.503 | 0.713 | 12.403 |
| 0.615 | 0.732 | 12.403 |
| 0.727 | 0.744 | 12.403 |
| 0.841 | 0.751 | 12.403 |
| 0.954 | 0.752 | 12.403 |
| 1.067 | 0.746 | 12.403 |
| 1.180 | 0.733 | 12.403 |
| 1.292 | 0.714 | 12.403 |
| 1.402 | 0.688 | 12.403 |
| 1.511 | 0.654 | 12.403 |
| 1.616 | 0.613 | 12.403 |
| 1.718 | 0.564 | 12.403 |
| 1.817 | 0.507 | 12.403 |
| 1.910 | 0.443 | 12.403 |
| 1.998 | 0.371 | 12.403 |
| 2.079 | 0.292 | 12.403 |
| 2.066 | 0.399 | 13.530 |
| 2.060 | 0.302 | 13.530 |
| 1.955 | 0.289 | 13.530 |
| 1.846 | 0.295 | 13.530 |
| 1.737 | 0.302 | 13.530 |
| 1.628 | 0.310 | 13.530 |
| 1.520 | 0.316 | 13.530 |
| 1.411 | 0.321 | 13.530 |
| 1.301 | 0.323 | 13.530 |
| 1.192 | 0.324 | 13.530 |
| 1.083 | 0.322 | 13.530 |
| 0.974 | 0.316 | 13.530 |
| 0.866 | 0.307 | 13.530 |
| 0.757 | 0.294 | 13.530 |
| 0.649 | 0.278 | 13.530 |
| 0.542 | 0.259 | 13.530 |
| 0.435 | 0.236 | 13.530 |
| 0.329 | 0.210 | 13.530 |
| 0.224 | 0.181 | 13.530 |
| 0.120 | 0.149 | 13.530 |
| 0.017 | 0.113 | 13.530 |
| −0.086 | 0.075 | 13.530 |
| −0.187 | 0.034 | 13.530 |
| −0.287 | −0.009 | 13.530 |
| −0.386 | −0.055 | 13.530 |
| −0.484 | −0.104 | 13.530 |
| −0.580 | −0.154 | 13.530 |
| −0.676 | −0.207 | 13.530 |
| −0.771 | −0.261 | 13.530 |
| −0.864 | −0.317 | 13.530 |
| −0.957 | −0.374 | 13.530 |
| −1.049 | −0.433 | 13.530 |
| −1.140 | −0.493 | 13.530 |
| −1.231 | −0.553 | 13.530 |
| −1.321 | −0.615 | 13.530 |
| −1.411 | −0.677 | 13.530 |
| −1.500 | −0.740 | 13.530 |
| −1.589 | −0.803 | 13.530 |
| −1.677 | −0.867 | 13.530 |
| −1.766 | −0.931 | 13.530 |
| −1.854 | −0.995 | 13.530 |
| −1.942 | −1.060 | 13.530 |
| −2.030 | −1.124 | 13.530 |
| −2.118 | −1.188 | 13.530 |
| −2.207 | −1.252 | 13.530 |
| −2.296 | −1.315 | 13.530 |
| −2.385 | −1.378 | 13.530 |
| −2.475 | −1.440 | 13.530 |
| −2.566 | −1.500 | 13.530 |
| −2.659 | −1.472 | 13.530 |

TABLE 1-continued

| X | Y | Z |
|---|---|---|
| −2.623 | −1.379 | 13.530 |
| −2.539 | −1.309 | 13.530 |
| −2.455 | −1.241 | 13.530 |
| −2.370 | −1.172 | 13.530 |
| −2.284 | −1.104 | 13.530 |
| −2.199 | −1.037 | 13.530 |
| −2.113 | −0.969 | 13.530 |
| −2.028 | −0.901 | 13.530 |
| −1.942 | −0.833 | 13.530 |
| −1.857 | −0.765 | 13.530 |
| −1.771 | −0.698 | 13.530 |
| −1.686 | −0.630 | 13.530 |
| −1.600 | −0.562 | 13.530 |
| −1.514 | −0.495 | 13.530 |
| −1.428 | −0.428 | 13.530 |
| −1.342 | −0.360 | 13.530 |
| −1.256 | −0.294 | 13.530 |
| −1.169 | −0.228 | 13.530 |
| −1.082 | −0.162 | 13.530 |
| −0.994 | −0.097 | 13.530 |
| −0.906 | −0.033 | 13.530 |
| −0.817 | 0.031 | 13.530 |
| −0.728 | 0.093 | 13.530 |
| −0.638 | 0.155 | 13.530 |
| −0.547 | 0.215 | 13.530 |
| −0.455 | 0.274 | 13.530 |
| −0.362 | 0.331 | 13.530 |
| −0.268 | 0.386 | 13.530 |
| −0.172 | 0.439 | 13.530 |
| −0.075 | 0.489 | 13.530 |
| 0.023 | 0.536 | 13.530 |
| 0.123 | 0.581 | 13.530 |
| 0.224 | 0.622 | 13.530 |
| 0.326 | 0.659 | 13.530 |
| 0.430 | 0.692 | 13.530 |
| 0.535 | 0.721 | 13.530 |
| 0.642 | 0.745 | 13.530 |
| 0.749 | 0.763 | 13.530 |
| 0.858 | 0.776 | 13.530 |
| 0.967 | 0.783 | 13.530 |
| 1.076 | 0.784 | 13.530 |
| 1.185 | 0.780 | 13.530 |
| 1.293 | 0.768 | 13.530 |
| 1.401 | 0.750 | 13.530 |
| 1.507 | 0.723 | 13.530 |
| 1.610 | 0.689 | 13.530 |
| 1.711 | 0.648 | 13.530 |
| 1.808 | 0.598 | 13.530 |
| 1.901 | 0.541 | 13.530 |
| 1.987 | 0.474 | 13.530 |
| 1.978 | 0.589 | 14.658 |
| 1.987 | 0.496 | 14.658 |
| 1.888 | 0.472 | 14.658 |
| 1.783 | 0.467 | 14.658 |
| 1.678 | 0.463 | 14.658 |
| 1.573 | 0.460 | 14.658 |
| 1.467 | 0.455 | 14.658 |
| 1.362 | 0.448 | 14.658 |
| 1.258 | 0.439 | 14.658 |
| 1.153 | 0.429 | 14.658 |
| 1.048 | 0.416 | 14.658 |
| 0.944 | 0.400 | 14.658 |
| 0.841 | 0.382 | 14.658 |
| 0.738 | 0.361 | 14.658 |
| 0.635 | 0.337 | 14.658 |
| 0.533 | 0.311 | 14.658 |
| 0.432 | 0.281 | 14.658 |
| 0.332 | 0.249 | 14.658 |
| 0.233 | 0.213 | 14.658 |
| 0.135 | 0.175 | 14.658 |
| 0.038 | 0.135 | 14.658 |
| −0.058 | 0.092 | 14.658 |
| −0.153 | 0.047 | 14.658 |
| −0.247 | −0.001 | 14.658 |
| −0.340 | −0.050 | 14.658 |
| −0.432 | −0.101 | 14.658 |
| −0.523 | −0.154 | 14.658 |
| −0.613 | −0.209 | 14.658 |

TABLE 1-continued

| X | Y | Z |
|---|---|---|
| −0.702 | −0.265 | 14.658 |
| −0.789 | −0.323 | 14.658 |
| −0.876 | −0.382 | 14.658 |
| −0.963 | −0.442 | 14.658 |
| −1.048 | −0.504 | 14.658 |
| −1.134 | −0.565 | 14.658 |
| −1.218 | −0.628 | 14.658 |
| −1.302 | −0.691 | 14.658 |
| −1.386 | −0.755 | 14.658 |
| −1.470 | −0.819 | 14.658 |
| −1.553 | −0.883 | 14.658 |
| −1.636 | −0.948 | 14.658 |
| −1.719 | −1.013 | 14.658 |
| −1.801 | −1.078 | 14.658 |
| −1.884 | −1.143 | 14.658 |
| −1.967 | −1.207 | 14.658 |
| −2.050 | −1.272 | 14.658 |
| −2.134 | −1.336 | 14.658 |
| −2.218 | −1.399 | 14.658 |
| −2.302 | −1.462 | 14.658 |
| −2.388 | −1.524 | 14.658 |
| −2.483 | −1.542 | 14.658 |
| −2.499 | −1.450 | 14.658 |
| −2.420 | −1.381 | 14.658 |
| −2.340 | −1.312 | 14.658 |
| −2.260 | −1.245 | 14.658 |
| −2.179 | −1.177 | 14.658 |
| −2.098 | −1.110 | 14.658 |
| −2.018 | −1.042 | 14.658 |
| −1.937 | −0.975 | 14.658 |
| −1.856 | −0.908 | 14.658 |
| −1.775 | −0.840 | 14.658 |
| −1.694 | −0.773 | 14.658 |
| −1.613 | −0.706 | 14.658 |
| −1.532 | −0.638 | 14.658 |
| −1.451 | −0.571 | 14.658 |
| −1.370 | −0.504 | 14.658 |
| −1.289 | −0.437 | 14.658 |
| −1.208 | −0.370 | 14.658 |
| −1.126 | −0.304 | 14.658 |
| −1.044 | −0.239 | 14.658 |
| −0.961 | −0.173 | 14.658 |
| −0.878 | −0.109 | 14.658 |
| −0.795 | −0.045 | 14.658 |
| −0.711 | 0.019 | 14.658 |
| −0.626 | 0.082 | 14.658 |
| −0.541 | 0.143 | 14.658 |
| −0.455 | 0.204 | 14.658 |
| −0.368 | 0.263 | 14.658 |
| −0.280 | 0.321 | 14.658 |
| −0.191 | 0.378 | 14.658 |
| −0.101 | 0.432 | 14.658 |
| −0.010 | 0.484 | 14.658 |
| 0.083 | 0.534 | 14.658 |
| 0.177 | 0.581 | 14.658 |
| 0.272 | 0.625 | 14.658 |
| 0.369 | 0.666 | 14.658 |
| 0.468 | 0.703 | 14.658 |
| 0.567 | 0.737 | 14.658 |
| 0.668 | 0.766 | 14.658 |
| 0.771 | 0.791 | 14.658 |
| 0.874 | 0.810 | 14.658 |
| 0.978 | 0.824 | 14.658 |
| 1.083 | 0.832 | 14.658 |
| 1.188 | 0.835 | 14.658 |
| 1.294 | 0.831 | 14.658 |
| 1.398 | 0.819 | 14.658 |
| 1.502 | 0.801 | 14.658 |
| 1.604 | 0.775 | 14.658 |
| 1.704 | 0.742 | 14.658 |
| 1.800 | 0.700 | 14.658 |
| 1.892 | 0.649 | 14.658 |
| 1.885 | 0.769 | 15.785 |
| 1.910 | 0.682 | 15.785 |
| 1.820 | 0.644 | 15.785 |
| 1.719 | 0.630 | 15.785 |
| 1.619 | 0.616 | 15.785 |
| 1.518 | 0.601 | 15.785 |

TABLE 1-continued

| X | Y | Z |
|---|---|---|
| 1.418 | 0.585 | 15.785 |
| 1.317 | 0.567 | 15.785 |
| 1.217 | 0.547 | 15.785 |
| 1.118 | 0.527 | 15.785 |
| 1.019 | 0.504 | 15.785 |
| 0.920 | 0.479 | 15.785 |
| 0.822 | 0.453 | 15.785 |
| 0.724 | 0.424 | 15.785 |
| 0.627 | 0.393 | 15.785 |
| 0.531 | 0.360 | 15.785 |
| 0.436 | 0.324 | 15.785 |
| 0.341 | 0.286 | 15.785 |
| 0.248 | 0.246 | 15.785 |
| 0.155 | 0.203 | 15.785 |
| 0.064 | 0.158 | 15.785 |
| −0.027 | 0.112 | 15.785 |
| −0.116 | 0.063 | 15.785 |
| −0.205 | 0.013 | 15.785 |
| −0.292 | −0.039 | 15.785 |
| −0.379 | −0.093 | 15.785 |
| −0.464 | −0.148 | 15.785 |
| −0.548 | −0.205 | 15.785 |
| −0.632 | −0.263 | 15.785 |
| −0.715 | −0.322 | 15.785 |
| −0.797 | −0.383 | 15.785 |
| −0.878 | −0.444 | 15.785 |
| −0.959 | −0.506 | 15.785 |
| −1.039 | −0.569 | 15.785 |
| −1.118 | −0.632 | 15.785 |
| −1.198 | −0.696 | 15.785 |
| −1.277 | −0.760 | 15.785 |
| −1.356 | −0.825 | 15.785 |
| −1.434 | −0.890 | 15.785 |
| −1.512 | −0.955 | 15.785 |
| −1.590 | −1.020 | 15.785 |
| −1.668 | −1.085 | 15.785 |
| −1.746 | −1.151 | 15.785 |
| −1.825 | −1.216 | 15.785 |
| −1.903 | −1.281 | 15.785 |
| −1.982 | −1.345 | 15.785 |
| −2.061 | −1.409 | 15.785 |
| −2.140 | −1.473 | 15.785 |
| −2.221 | −1.535 | 15.785 |
| −2.307 | −1.584 | 15.785 |
| −2.368 | −1.517 | 15.785 |
| −2.306 | −1.440 | 15.785 |
| −2.230 | −1.371 | 15.785 |
| −2.154 | −1.304 | 15.785 |
| −2.077 | −1.237 | 15.785 |
| −2.001 | −1.170 | 15.785 |
| −1.924 | −1.102 | 15.785 |
| −1.848 | −1.035 | 15.785 |
| −1.771 | −0.968 | 15.785 |
| −1.694 | −0.901 | 15.785 |
| −1.618 | −0.834 | 15.785 |
| −1.541 | −0.767 | 15.785 |
| −1.465 | −0.700 | 15.785 |
| −1.388 | −0.634 | 15.785 |
| −1.311 | −0.567 | 15.785 |
| −1.234 | −0.500 | 15.785 |
| −1.157 | −0.434 | 15.785 |
| −1.080 | −0.368 | 15.785 |
| −1.002 | −0.302 | 15.785 |
| −0.924 | −0.237 | 15.785 |
| −0.845 | −0.172 | 15.785 |
| −0.767 | −0.107 | 15.785 |
| −0.687 | −0.043 | 15.785 |
| −0.608 | 0.020 | 15.785 |
| −0.528 | 0.083 | 15.785 |
| −0.447 | 0.145 | 15.785 |
| −0.366 | 0.206 | 15.785 |
| −0.284 | 0.266 | 15.785 |
| −0.201 | 0.325 | 15.785 |
| −0.117 | 0.383 | 15.785 |
| −0.032 | 0.439 | 15.785 |
| 0.055 | 0.492 | 15.785 |
| 0.142 | 0.544 | 15.785 |
| 0.231 | 0.594 | 15.785 |

TABLE 1-continued

| X | Y | Z |
|---|---|---|
| 0.321 | 0.642 | 15.785 |
| 0.413 | 0.686 | 15.785 |
| 0.505 | 0.728 | 15.785 |
| 0.600 | 0.766 | 15.785 |
| 0.695 | 0.801 | 15.785 |
| 0.793 | 0.831 | 15.785 |
| 0.891 | 0.856 | 15.785 |
| 0.991 | 0.876 | 15.785 |
| 1.092 | 0.891 | 15.785 |
| 1.193 | 0.900 | 15.785 |
| 1.295 | 0.903 | 15.785 |
| 1.397 | 0.899 | 15.785 |
| 1.498 | 0.889 | 15.785 |
| 1.598 | 0.871 | 15.785 |
| 1.696 | 0.846 | 15.785 |
| 1.792 | 0.812 | 15.785 |
| 1.787 | 0.932 | 16.913 |
| 1.828 | 0.854 | 16.913 |
| 1.751 | 0.802 | 16.913 |
| 1.655 | 0.779 | 16.913 |
| 1.559 | 0.754 | 16.913 |
| 1.464 | 0.729 | 16.913 |
| 1.369 | 0.702 | 16.913 |
| 1.274 | 0.674 | 16.913 |
| 1.179 | 0.645 | 16.913 |
| 1.085 | 0.615 | 16.913 |
| 0.992 | 0.583 | 16.913 |
| 0.899 | 0.550 | 16.913 |
| 0.806 | 0.516 | 16.913 |
| 0.714 | 0.479 | 16.913 |
| 0.623 | 0.442 | 16.913 |
| 0.532 | 0.402 | 16.913 |
| 0.442 | 0.361 | 16.913 |
| 0.353 | 0.318 | 16.913 |
| 0.265 | 0.274 | 16.913 |
| 0.178 | 0.227 | 16.913 |
| 0.092 | 0.179 | 16.913 |
| 0.006 | 0.129 | 16.913 |
| −0.078 | 0.078 | 16.913 |
| −0.162 | 0.025 | 16.913 |
| −0.244 | −0.029 | 16.913 |
| −0.326 | −0.085 | 16.913 |
| −0.406 | −0.142 | 16.913 |
| −0.486 | −0.200 | 16.913 |
| −0.565 | −0.260 | 16.913 |
| −0.643 | −0.320 | 16.913 |
| −0.721 | −0.381 | 16.913 |
| −0.798 | −0.443 | 16.913 |
| −0.874 | −0.506 | 16.913 |
| −0.950 | −0.569 | 16.913 |
| −1.026 | −0.633 | 16.913 |
| −1.101 | −0.697 | 16.913 |
| −1.176 | −0.761 | 16.913 |
| −1.250 | −0.826 | 16.913 |
| −1.325 | −0.892 | 16.913 |
| −1.399 | −0.957 | 16.913 |
| −1.472 | −1.023 | 16.913 |
| −1.546 | −1.089 | 16.913 |
| −1.620 | −1.154 | 16.913 |
| −1.694 | −1.220 | 16.913 |
| −1.767 | −1.286 | 16.913 |
| −1.841 | −1.352 | 16.913 |
| −1.915 | −1.417 | 16.913 |
| −1.990 | −1.482 | 16.913 |
| −2.065 | −1.546 | 16.913 |
| −2.142 | −1.607 | 16.913 |
| −2.225 | −1.575 | 16.913 |
| −2.191 | −1.491 | 16.913 |
| −2.120 | −1.422 | 16.913 |
| −2.048 | −1.354 | 16.913 |
| −1.976 | −1.286 | 16.913 |
| −1.904 | −1.218 | 16.913 |
| −1.832 | −1.151 | 16.913 |
| −1.760 | −1.084 | 16.913 |
| −1.687 | −1.016 | 16.913 |
| −1.615 | −0.949 | 16.913 |
| −1.542 | −0.882 | 16.913 |
| −1.470 | −0.815 | 16.913 |

TABLE 1-continued

| X | Y | Z |
|---|---|---|
| −1.397 | −0.748 | 16.913 |
| −1.325 | −0.681 | 16.913 |
| −1.252 | −0.614 | 16.913 |
| −1.179 | −0.547 | 16.913 |
| −1.106 | −0.481 | 16.913 |
| −1.032 | −0.415 | 16.913 |
| −0.959 | −0.349 | 16.913 |
| −0.885 | −0.283 | 16.913 |
| −0.810 | −0.218 | 16.913 |
| −0.736 | −0.153 | 16.913 |
| −0.661 | −0.089 | 16.913 |
| −0.585 | −0.025 | 16.913 |
| −0.510 | 0.038 | 16.913 |
| −0.433 | 0.101 | 16.913 |
| −0.357 | 0.164 | 16.913 |
| −0.280 | 0.225 | 16.913 |
| −0.202 | 0.286 | 16.913 |
| −0.123 | 0.346 | 16.913 |
| −0.043 | 0.404 | 16.913 |
| 0.037 | 0.462 | 16.913 |
| 0.118 | 0.518 | 16.913 |
| 0.201 | 0.572 | 16.913 |
| 0.285 | 0.624 | 16.913 |
| 0.370 | 0.675 | 16.913 |
| 0.456 | 0.723 | 16.913 |
| 0.544 | 0.768 | 16.913 |
| 0.633 | 0.811 | 16.913 |
| 0.724 | 0.849 | 16.913 |
| 0.817 | 0.884 | 16.913 |
| 0.911 | 0.914 | 16.913 |
| 1.006 | 0.940 | 16.913 |
| 1.103 | 0.961 | 16.913 |
| 1.200 | 0.976 | 16.913 |
| 1.299 | 0.986 | 16.913 |
| 1.397 | 0.990 | 16.913 |
| 1.496 | 0.987 | 16.913 |
| 1.594 | 0.976 | 16.913 |
| 1.691 | 0.958 | 16.913 |
| 1.685 | 1.080 | 18.040 |
| 1.738 | 1.011 | 18.040 |
| 1.673 | 0.949 | 18.040 |
| 1.583 | 0.915 | 18.040 |
| 1.493 | 0.881 | 18.040 |
| 1.404 | 0.846 | 18.040 |
| 1.314 | 0.810 | 18.040 |
| 1.226 | 0.773 | 18.040 |
| 1.137 | 0.735 | 18.040 |
| 1.049 | 0.697 | 18.040 |
| 0.962 | 0.657 | 18.040 |
| 0.875 | 0.616 | 18.040 |
| 0.788 | 0.574 | 18.040 |
| 0.702 | 0.531 | 18.040 |
| 0.616 | 0.487 | 18.040 |
| 0.532 | 0.442 | 18.040 |
| 0.447 | 0.396 | 18.040 |
| 0.364 | 0.348 | 18.040 |
| 0.281 | 0.299 | 18.040 |
| 0.199 | 0.249 | 18.040 |
| 0.117 | 0.198 | 18.040 |
| 0.037 | 0.145 | 18.040 |
| −0.042 | 0.091 | 18.040 |
| −0.121 | 0.035 | 18.040 |
| −0.199 | −0.021 | 18.040 |
| −0.276 | −0.079 | 18.040 |
| −0.352 | −0.137 | 18.040 |
| −0.428 | −0.197 | 18.040 |
| −0.503 | −0.257 | 18.040 |
| −0.577 | −0.319 | 18.040 |
| −0.650 | −0.380 | 18.040 |
| −0.724 | −0.443 | 18.040 |
| −0.796 | −0.506 | 18.040 |
| −0.869 | −0.569 | 18.040 |
| −0.940 | −0.633 | 18.040 |
| −1.012 | −0.698 | 18.040 |
| −1.083 | −0.762 | 18.040 |
| −1.154 | −0.827 | 18.040 |
| −1.224 | −0.893 | 18.040 |
| −1.294 | −0.959 | 18.040 |

TABLE 1-continued

| X | Y | Z |
|---|---|---|
| −1.364 | −1.025 | 18.040 |
| −1.434 | −1.091 | 18.040 |
| −1.504 | −1.157 | 18.040 |
| −1.573 | −1.224 | 18.040 |
| −1.643 | −1.290 | 18.040 |
| −1.712 | −1.357 | 18.040 |
| −1.782 | −1.423 | 18.040 |
| −1.852 | −1.489 | 18.040 |
| −1.922 | −1.555 | 18.040 |
| −1.993 | −1.620 | 18.040 |
| −2.079 | −1.619 | 18.040 |
| −2.076 | −1.533 | 18.040 |
| −2.009 | −1.463 | 18.040 |
| −1.942 | −1.394 | 18.040 |
| −1.875 | −1.326 | 18.040 |
| −1.807 | −1.258 | 18.040 |
| −1.739 | −1.190 | 18.040 |
| −1.671 | −1.122 | 18.040 |
| −1.602 | −1.054 | 18.040 |
| −1.534 | −0.986 | 18.040 |
| −1.466 | −0.919 | 18.040 |
| −1.397 | −0.851 | 18.040 |
| −1.328 | −0.784 | 18.040 |
| −1.259 | −0.717 | 18.040 |
| −1.190 | −0.650 | 18.040 |
| −1.121 | −0.583 | 18.040 |
| −1.052 | −0.517 | 18.040 |
| −0.982 | −0.450 | 18.040 |
| −0.912 | −0.384 | 18.040 |
| −0.842 | −0.318 | 18.040 |
| −0.772 | −0.253 | 18.040 |
| −0.701 | −0.188 | 18.040 |
| −0.630 | −0.123 | 18.040 |
| −0.559 | −0.058 | 18.040 |
| −0.487 | 0.006 | 18.040 |
| −0.415 | 0.069 | 18.040 |
| −0.342 | 0.132 | 18.040 |
| −0.269 | 0.195 | 18.040 |
| −0.196 | 0.257 | 18.040 |
| −0.122 | 0.319 | 18.040 |
| −0.048 | 0.380 | 18.040 |
| 0.028 | 0.440 | 18.040 |
| 0.103 | 0.499 | 18.040 |
| 0.180 | 0.557 | 18.040 |
| 0.258 | 0.613 | 18.040 |
| 0.337 | 0.668 | 18.040 |
| 0.417 | 0.721 | 18.040 |
| 0.499 | 0.772 | 18.040 |
| 0.582 | 0.821 | 18.040 |
| 0.666 | 0.867 | 18.040 |
| 0.753 | 0.909 | 18.040 |
| 0.840 | 0.948 | 18.040 |
| 0.930 | 0.984 | 18.040 |
| 1.021 | 1.015 | 18.040 |
| 1.113 | 1.042 | 18.040 |
| 1.207 | 1.064 | 18.040 |
| 1.301 | 1.080 | 18.040 |
| 1.397 | 1.091 | 18.040 |
| 1.493 | 1.095 | 18.040 |
| 1.589 | 1.091 | 18.040 |
| 1.578 | 1.216 | 19.168 |
| 1.637 | 1.155 | 19.168 |
| 1.580 | 1.088 | 19.168 |
| 1.497 | 1.044 | 19.168 |
| 1.414 | 1.000 | 19.168 |
| 1.331 | 0.956 | 19.168 |
| 1.249 | 0.912 | 19.168 |
| 1.166 | 0.867 | 19.168 |
| 1.084 | 0.822 | 19.168 |
| 1.003 | 0.776 | 19.168 |
| 0.922 | 0.729 | 19.168 |
| 0.841 | 0.681 | 19.168 |
| 0.761 | 0.633 | 19.168 |
| 0.681 | 0.583 | 19.168 |
| 0.602 | 0.534 | 19.168 |
| 0.523 | 0.483 | 19.168 |
| 0.445 | 0.431 | 19.168 |
| 0.367 | 0.379 | 19.168 |

TABLE 1-continued

| X | Y | Z |
|---|---|---|
| 0.290 | 0.326 | 19.168 |
| 0.213 | 0.272 | 19.168 |
| 0.137 | 0.217 | 19.168 |
| 0.062 | 0.161 | 19.168 |
| −0.012 | 0.104 | 19.168 |
| −0.086 | 0.046 | 19.168 |
| −0.159 | −0.013 | 19.168 |
| −0.231 | −0.073 | 19.168 |
| −0.303 | −0.133 | 19.168 |
| −0.374 | −0.194 | 19.168 |
| −0.445 | −0.255 | 19.168 |
| −0.515 | −0.317 | 19.168 |
| −0.584 | −0.380 | 19.168 |
| −0.654 | −0.443 | 19.168 |
| −0.723 | −0.507 | 19.168 |
| −0.791 | −0.571 | 19.168 |
| −0.859 | −0.635 | 19.168 |
| −0.927 | −0.699 | 19.168 |
| −0.995 | −0.764 | 19.168 |
| −1.062 | −0.830 | 19.168 |
| −1.129 | −0.895 | 19.168 |
| −1.196 | −0.961 | 19.168 |
| −1.262 | −1.027 | 19.168 |
| −1.328 | −1.093 | 19.168 |
| −1.395 | −1.160 | 19.168 |
| −1.461 | −1.226 | 19.168 |
| −1.527 | −1.293 | 19.168 |
| −1.592 | −1.359 | 19.168 |
| −1.658 | −1.426 | 19.168 |
| −1.724 | −1.493 | 19.168 |
| −1.790 | −1.559 | 19.168 |
| −1.857 | −1.625 | 19.168 |
| −1.940 | −1.645 | 19.168 |
| −1.960 | −1.563 | 19.168 |
| −1.898 | −1.493 | 19.168 |
| −1.834 | −1.424 | 19.168 |
| −1.770 | −1.355 | 19.168 |
| −1.706 | −1.287 | 19.168 |
| −1.642 | −1.219 | 19.168 |
| −1.577 | −1.151 | 19.168 |
| −1.513 | −1.083 | 19.168 |
| −1.448 | −1.015 | 19.168 |
| −1.383 | −0.948 | 19.168 |
| −1.318 | −0.880 | 19.168 |
| −1.252 | −0.813 | 19.168 |
| −1.187 | −0.746 | 19.168 |
| −1.121 | −0.679 | 19.168 |
| −1.056 | −0.612 | 19.168 |
| −0.990 | −0.545 | 19.168 |
| −0.924 | −0.479 | 19.168 |
| −0.858 | −0.413 | 19.168 |
| −0.791 | −0.347 | 19.168 |
| −0.725 | −0.281 | 19.168 |
| −0.658 | −0.215 | 19.168 |
| −0.591 | −0.150 | 19.168 |
| −0.523 | −0.084 | 19.168 |
| −0.456 | −0.020 | 19.168 |
| −0.388 | 0.045 | 19.168 |
| −0.320 | 0.109 | 19.168 |
| −0.251 | 0.173 | 19.168 |
| −0.182 | 0.237 | 19.168 |
| −0.113 | 0.300 | 19.168 |
| −0.043 | 0.362 | 19.168 |
| 0.027 | 0.425 | 19.168 |
| 0.097 | 0.486 | 19.168 |
| 0.169 | 0.547 | 19.168 |
| 0.241 | 0.607 | 19.168 |
| 0.314 | 0.666 | 19.168 |
| 0.388 | 0.723 | 19.168 |
| 0.463 | 0.779 | 19.168 |
| 0.540 | 0.832 | 19.168 |
| 0.618 | 0.884 | 19.168 |
| 0.698 | 0.934 | 19.168 |
| 0.779 | 0.981 | 19.168 |
| 0.861 | 1.025 | 19.168 |
| 0.946 | 1.066 | 19.168 |
| 1.032 | 1.103 | 19.168 |
| 1.119 | 1.136 | 19.168 |

TABLE 1-continued

| X | Y | Z |
|---|---|---|
| 1.209 | 1.164 | 19.168 |
| 1.299 | 1.187 | 19.168 |
| 1.392 | 1.205 | 19.168 |
| 1.485 | 1.214 | 19.168 |
| 1.470 | 1.343 | 20.295 |
| 1.533 | 1.291 | 20.295 |
| 1.485 | 1.220 | 20.295 |
| 1.411 | 1.166 | 20.295 |
| 1.335 | 1.114 | 20.295 |
| 1.259 | 1.063 | 20.295 |
| 1.183 | 1.013 | 20.295 |
| 1.108 | 0.961 | 20.295 |
| 1.032 | 0.909 | 20.295 |
| 0.957 | 0.857 | 20.295 |
| 0.883 | 0.804 | 20.295 |
| 0.808 | 0.751 | 20.295 |
| 0.734 | 0.697 | 20.295 |
| 0.661 | 0.642 | 20.295 |
| 0.588 | 0.587 | 20.295 |
| 0.515 | 0.532 | 20.295 |
| 0.443 | 0.476 | 20.295 |
| 0.371 | 0.419 | 20.295 |
| 0.300 | 0.361 | 20.295 |
| 0.229 | 0.303 | 20.295 |
| 0.159 | 0.245 | 20.295 |
| 0.089 | 0.185 | 20.295 |
| 0.020 | 0.126 | 20.295 |
| −0.048 | 0.065 | 20.295 |
| −0.117 | 0.004 | 20.295 |
| −0.184 | −0.058 | 20.295 |
| −0.251 | −0.120 | 20.295 |
| −0.318 | −0.182 | 20.295 |
| −0.385 | −0.245 | 20.295 |
| −0.451 | −0.308 | 20.295 |
| −0.517 | −0.372 | 20.295 |
| −0.582 | −0.436 | 20.295 |
| −0.647 | −0.500 | 20.295 |
| −0.712 | −0.565 | 20.295 |
| −0.776 | −0.629 | 20.295 |
| −0.841 | −0.695 | 20.295 |
| −0.905 | −0.760 | 20.295 |
| −0.968 | −0.825 | 20.295 |
| −1.032 | −0.891 | 20.295 |
| −1.095 | −0.957 | 20.295 |
| −1.159 | −1.023 | 20.295 |
| −1.222 | −1.090 | 20.295 |
| −1.285 | −1.156 | 20.295 |
| −1.348 | −1.222 | 20.295 |
| −1.411 | −1.289 | 20.295 |
| −1.473 | −1.355 | 20.295 |
| −1.536 | −1.422 | 20.295 |
| −1.599 | −1.489 | 20.295 |
| −1.662 | −1.555 | 20.295 |
| −1.725 | −1.621 | 20.295 |
| −1.802 | −1.658 | 20.295 |
| −1.841 | −1.586 | 20.295 |
| −1.786 | −1.514 | 20.295 |
| −1.726 | −1.445 | 20.295 |
| −1.665 | −1.376 | 20.295 |
| −1.604 | −1.308 | 20.295 |
| −1.543 | −1.240 | 20.295 |
| −1.482 | −1.172 | 20.295 |
| −1.420 | −1.104 | 20.295 |
| −1.359 | −1.037 | 20.295 |
| −1.297 | −0.969 | 20.295 |
| −1.235 | −0.902 | 20.295 |
| −1.173 | −0.835 | 20.295 |
| −1.111 | −0.768 | 20.295 |
| −1.049 | −0.701 | 20.295 |
| −0.986 | −0.634 | 20.295 |
| −0.924 | −0.567 | 20.295 |
| −0.861 | −0.500 | 20.295 |
| −0.799 | −0.433 | 20.295 |
| −0.736 | −0.367 | 20.295 |
| −0.673 | −0.300 | 20.295 |
| −0.610 | −0.234 | 20.295 |
| −0.547 | −0.168 | 20.295 |
| −0.484 | −0.102 | 20.295 |

TABLE 1-continued

| X | Y | Z |
|---|---|---|
| −0.420 | −0.036 | 20.295 |
| −0.356 | 0.030 | 20.295 |
| −0.292 | 0.095 | 20.295 |
| −0.228 | 0.161 | 20.295 |
| −0.164 | 0.225 | 20.295 |
| −0.099 | 0.290 | 20.295 |
| −0.034 | 0.355 | 20.295 |
| 0.031 | 0.419 | 20.295 |
| 0.097 | 0.482 | 20.295 |
| 0.163 | 0.545 | 20.295 |
| 0.230 | 0.608 | 20.295 |
| 0.298 | 0.669 | 20.295 |
| 0.366 | 0.730 | 20.295 |
| 0.435 | 0.790 | 20.295 |
| 0.506 | 0.848 | 20.295 |
| 0.577 | 0.905 | 20.295 |
| 0.650 | 0.960 | 20.295 |
| 0.725 | 1.014 | 20.295 |
| 0.800 | 1.065 | 20.295 |
| 0.878 | 1.114 | 20.295 |
| 0.957 | 1.160 | 20.295 |
| 1.037 | 1.203 | 20.295 |
| 1.120 | 1.242 | 20.295 |
| 1.204 | 1.278 | 20.295 |
| 1.291 | 1.307 | 20.295 |
| 1.380 | 1.330 | 20.295 |
| 1.363 | 1.467 | 21.423 |
| 1.436 | 1.432 | 21.423 |
| 1.411 | 1.353 | 21.423 |
| 1.344 | 1.293 | 21.423 |
| 1.276 | 1.234 | 21.423 |
| 1.207 | 1.177 | 21.423 |
| 1.137 | 1.120 | 21.423 |
| 1.068 | 1.063 | 21.423 |
| 0.999 | 1.006 | 21.423 |
| 0.930 | 0.949 | 21.423 |
| 0.861 | 0.891 | 21.423 |
| 0.793 | 0.833 | 21.423 |
| 0.725 | 0.775 | 21.423 |
| 0.657 | 0.716 | 21.423 |
| 0.590 | 0.657 | 21.423 |
| 0.522 | 0.597 | 21.423 |
| 0.456 | 0.537 | 21.423 |
| 0.390 | 0.476 | 21.423 |
| 0.324 | 0.416 | 21.423 |
| 0.258 | 0.354 | 21.423 |
| 0.193 | 0.293 | 21.423 |
| 0.128 | 0.230 | 21.423 |
| 0.064 | 0.168 | 21.423 |
| 0.000 | 0.105 | 21.423 |
| −0.064 | 0.042 | 21.423 |
| −0.127 | −0.022 | 21.423 |
| −0.190 | −0.086 | 21.423 |
| −0.253 | −0.150 | 21.423 |
| −0.315 | −0.214 | 21.423 |
| −0.378 | −0.279 | 21.423 |
| −0.440 | −0.344 | 21.423 |
| −0.501 | −0.409 | 21.423 |
| −0.563 | −0.474 | 21.423 |
| −0.624 | −0.540 | 21.423 |
| −0.685 | −0.606 | 21.423 |
| −0.746 | −0.672 | 21.423 |
| −0.806 | −0.738 | 21.423 |
| −0.867 | −0.804 | 21.423 |
| −0.927 | −0.871 | 21.423 |
| −0.987 | −0.937 | 21.423 |
| −1.047 | −1.004 | 21.423 |
| −1.106 | −1.071 | 21.423 |
| −1.166 | −1.138 | 21.423 |
| −1.226 | −1.205 | 21.423 |
| −1.285 | −1.272 | 21.423 |
| −1.345 | −1.340 | 21.423 |
| −1.404 | −1.407 | 21.423 |
| −1.463 | −1.474 | 21.423 |
| −1.523 | −1.541 | 21.423 |
| −1.582 | −1.609 | 21.423 |
| −1.650 | −1.664 | 21.423 |
| −1.714 | −1.615 | 21.423 |

TABLE 1-continued

| X | Y | Z |
|---|---|---|
| −1.674 | −1.538 | 21.423 |
| −1.618 | −1.468 | 21.423 |
| −1.561 | −1.398 | 21.423 |
| −1.504 | −1.329 | 21.423 |
| −1.447 | −1.260 | 21.423 |
| −1.389 | −1.191 | 21.423 |
| −1.332 | −1.122 | 21.423 |
| −1.274 | −1.054 | 21.423 |
| −1.216 | −0.985 | 21.423 |
| −1.157 | −0.917 | 21.423 |
| −1.099 | −0.849 | 21.423 |
| −1.040 | −0.781 | 21.423 |
| −0.981 | −0.713 | 21.423 |
| −0.923 | −0.646 | 21.423 |
| −0.864 | −0.578 | 21.423 |
| −0.805 | −0.510 | 21.423 |
| −0.746 | −0.443 | 21.423 |
| −0.687 | −0.375 | 21.423 |
| −0.628 | −0.308 | 21.423 |
| −0.568 | −0.240 | 21.423 |
| −0.509 | −0.173 | 21.423 |
| −0.449 | −0.106 | 21.423 |
| −0.390 | −0.039 | 21.423 |
| −0.330 | 0.028 | 21.423 |
| −0.270 | 0.095 | 21.423 |
| −0.210 | 0.161 | 21.423 |
| −0.149 | 0.227 | 21.423 |
| −0.088 | 0.293 | 21.423 |
| −0.027 | 0.359 | 21.423 |
| 0.034 | 0.425 | 21.423 |
| 0.096 | 0.490 | 21.423 |
| 0.158 | 0.555 | 21.423 |
| 0.220 | 0.619 | 21.423 |
| 0.283 | 0.683 | 21.423 |
| 0.347 | 0.746 | 21.423 |
| 0.411 | 0.809 | 21.423 |
| 0.476 | 0.870 | 21.423 |
| 0.542 | 0.931 | 21.423 |
| 0.609 | 0.991 | 21.423 |
| 0.677 | 1.049 | 21.423 |
| 0.747 | 1.106 | 21.423 |
| 0.817 | 1.162 | 21.423 |
| 0.889 | 1.215 | 21.423 |
| 0.963 | 1.266 | 21.423 |
| 1.039 | 1.315 | 21.423 |
| 1.116 | 1.360 | 21.423 |
| 1.196 | 1.402 | 21.423 |
| 1.278 | 1.438 | 21.423 |
| 1.259 | 1.584 | 22.550 |
| 1.341 | 1.575 | 22.550 |
| 1.357 | 1.493 | 22.550 |
| 1.299 | 1.428 | 22.550 |
| 1.236 | 1.365 | 22.550 |
| 1.174 | 1.302 | 22.550 |
| 1.111 | 1.240 | 22.550 |
| 1.047 | 1.178 | 22.550 |
| 0.984 | 1.116 | 22.550 |
| 0.921 | 1.055 | 22.550 |
| 0.858 | 0.993 | 22.550 |
| 0.795 | 0.931 | 22.550 |
| 0.732 | 0.869 | 22.550 |
| 0.669 | 0.806 | 22.550 |
| 0.606 | 0.744 | 22.550 |
| 0.544 | 0.681 | 22.550 |
| 0.482 | 0.618 | 22.550 |
| 0.421 | 0.554 | 22.550 |
| 0.359 | 0.490 | 22.550 |
| 0.298 | 0.426 | 22.550 |
| 0.238 | 0.362 | 22.550 |
| 0.177 | 0.297 | 22.550 |
| 0.117 | 0.232 | 22.550 |
| 0.057 | 0.167 | 22.550 |
| −0.002 | 0.102 | 22.550 |
| −0.062 | 0.036 | 22.550 |
| −0.121 | −0.029 | 22.550 |
| −0.180 | −0.095 | 22.550 |
| −0.239 | −0.162 | 22.550 |
| −0.297 | −0.228 | 22.550 |

TABLE 1-continued

| X | Y | Z |
|---|---|---|
| −0.355 | −0.295 | 22.550 |
| −0.413 | −0.361 | 22.550 |
| −0.471 | −0.428 | 22.550 |
| −0.529 | −0.495 | 22.550 |
| −0.587 | −0.562 | 22.550 |
| −0.644 | −0.629 | 22.550 |
| −0.702 | −0.697 | 22.550 |
| −0.759 | −0.764 | 22.550 |
| −0.815 | −0.832 | 22.550 |
| −0.872 | −0.900 | 22.550 |
| −0.928 | −0.969 | 22.550 |
| −0.984 | −1.037 | 22.550 |
| −1.040 | −1.106 | 22.550 |
| −1.096 | −1.175 | 22.550 |
| −1.151 | −1.243 | 22.550 |
| −1.207 | −1.312 | 22.550 |
| −1.262 | −1.381 | 22.550 |
| −1.317 | −1.450 | 22.550 |
| −1.373 | −1.519 | 22.550 |
| −1.428 | −1.588 | 22.550 |
| −1.485 | −1.656 | 22.550 |
| −1.564 | −1.648 | 22.550 |
| −1.558 | −1.568 | 22.550 |
| −1.507 | −1.495 | 22.550 |
| −1.456 | −1.423 | 22.550 |
| −1.404 | −1.352 | 22.550 |
| −1.352 | −1.280 | 22.550 |
| −1.299 | −1.209 | 22.550 |
| −1.246 | −1.138 | 22.550 |
| −1.192 | −1.068 | 22.550 |
| −1.139 | −0.998 | 22.550 |
| −1.085 | −0.928 | 22.550 |
| −1.030 | −0.858 | 22.550 |
| −0.976 | −0.788 | 22.550 |
| −0.921 | −0.718 | 22.550 |
| −0.867 | −0.649 | 22.550 |
| −0.812 | −0.579 | 22.550 |
| −0.757 | −0.510 | 22.550 |
| −0.702 | −0.440 | 22.550 |
| −0.647 | −0.371 | 22.550 |
| −0.592 | −0.302 | 22.550 |
| −0.536 | −0.233 | 22.550 |
| −0.480 | −0.165 | 22.550 |
| −0.424 | −0.096 | 22.550 |
| −0.368 | −0.028 | 22.550 |
| −0.311 | 0.040 | 22.550 |
| −0.254 | 0.108 | 22.550 |
| −0.197 | 0.175 | 22.550 |
| −0.140 | 0.243 | 22.550 |
| −0.083 | 0.310 | 22.550 |
| −0.025 | 0.377 | 22.550 |
| 0.033 | 0.444 | 22.550 |
| 0.092 | 0.510 | 22.550 |
| 0.151 | 0.576 | 22.550 |
| 0.210 | 0.642 | 22.550 |
| 0.270 | 0.707 | 22.550 |
| 0.330 | 0.772 | 22.550 |
| 0.390 | 0.836 | 22.550 |
| 0.451 | 0.901 | 22.550 |
| 0.513 | 0.964 | 22.550 |
| 0.575 | 1.027 | 22.550 |
| 0.638 | 1.089 | 22.550 |
| 0.701 | 1.151 | 22.550 |
| 0.766 | 1.211 | 22.550 |
| 0.832 | 1.270 | 22.550 |
| 0.900 | 1.327 | 22.550 |
| 0.968 | 1.383 | 22.550 |
| 1.038 | 1.437 | 22.550 |
| 1.110 | 1.489 | 22.550 |
| 1.184 | 1.538 | 22.550 |

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A turbine blade having an attachment, a neck extending radially outward from the attachment, a platform extending radially outward from the neck, an airfoil extending radially outward from the platform, and a shroud extending radially outward from the airfoil, where the airfoil has an uncoated profile substantially in accordance with Cartesian coordinate values of X, Y, and Z as set forth in Table 1, carried to three decimal places, wherein Z is a distance measured radially from the platform.

2. The turbine blade of claim 1, wherein the airfoil has manufacturing tolerances of ±0.030 inches.

3. The turbine blade of claim 1, wherein a recessed region extends along a portion of an axial length of the platform.

4. The turbine blade of claim 3 further comprising a seal positioned within the recessed region.

5. The turbine blade of claim 1, wherein the blade is fabricated from a nickel-based alloy.

6. The turbine blade of claim 1 further comprising a MCrAlY bond coating applied to the airfoil.

7. The turbine blade of claim 6, wherein the coating is applied up to 0.0055 inches thick.

8. An airfoil for a turbine blade having an uncoated profile substantially in accordance with Cartesian coordinate values of X, Y, and Z as set forth in Table 1, carried to three decimal places, wherein Z is a distance measured radially from a platform of the turbine blade.

9. The airfoil of claim 8, wherein the airfoil has manufacturing tolerances of ±0.030 inches.

10. The airfoil of claim 9 further comprising a coating up to 0.0055 inches thick.

11. The airfoil of claim 10, wherein the coating is a MCrAlY bond coating.

12. A plurality of turbine blades secured to a rotor disk to form a rotor stage, the turbine blades each having a platform and an airfoil having an uncoated profile substantially in accordance with Cartesian coordinate values of X, Y, and Z as set forth in Table 1, carried to three decimal places, wherein Z is a distance measured radially from the platform.

13. The plurality of turbine blades of claim 12 further comprising a plurality of seals positioned between adjacent turbine blades.

14. The plurality of turbine blades of claim 13, wherein the seals are placed in a plurality of recessed regions that extend along a majority of a length of a platform of each turbine blade.

15. The plurality of turbine blades of claim 12, wherein each airfoil has manufacturing tolerances of ±0.030 inches.

16. The plurality of turbine blades of claim 12 further comprising a MCrAlY bond coating applied to each airfoil.

17. The plurality of turbine blades of claim 16, wherein the bond coating applied to each airfoil is approximately 0.0055 inches thick.

* * * * *